US008911571B2

(12) United States Patent
Ming

(10) Patent No.: US 8,911,571 B2
(45) Date of Patent: Dec. 16, 2014

(54) L, R, C METHOD AND EQUIPMENT FOR CONTINUOUS CASTING AMORPHOUS, ULTRACRYSTALLITE AND CRYSTALLITE METALLIC SLAB OR STRIP

(71) Applicant: Zhuwen Ming, North Strathfield (AU)

(72) Inventor: Zhuwen Ming, North Strathfield (AU)

( * ) Notice: Subject to any disclaimer, the term of this patent is extended or adjusted under 35 U.S.C. 154(b) by 0 days.

(21) Appl. No.: 13/861,505

(22) Filed: Apr. 12, 2013

(65) Prior Publication Data

US 2013/0220492 A1 Aug. 29, 2013

Related U.S. Application Data

(62) Division of application No. 11/911,721, filed as application No. PCT/CN2005/001108 on Jul. 25, 2005, now Pat. No. 8,418,746.

(51) Int. Cl.

| | |
|---|---|
| ***B22D 11/124*** | (2006.01) |
| ***B22D 11/22*** | (2006.01) |
| ***B22D 11/126*** | (2006.01) |
| ***B22D 11/14*** | (2006.01) |
| ***B22D 11/049*** | (2006.01) |

(52) U.S. Cl.

CPC ..... *B22D 11/1245* (2013.01); *B22D 11/225* (2013.01); *B22D 11/126* (2013.01); *B22D 11/145* (2013.01); *B22D 11/143* (2013.01); *B22D 11/049* (2013.01)

USPC ..... 148/538; 148/561; 148/577; 164/418; 164/419; 164/437; 164/443; 164/444

(58) Field of Classification Search

CPC ..... B22D 11/124–11/1248

USPC ..... 148/538, 559, 561, 577, 578; 164/122–128, 253, 348, 414, 415, 418, 164/419, 437, 439–444, 459, 474, 475, 486

See application file for complete search history.

(56) References Cited

U.S. PATENT DOCUMENTS 5,074,353 A * 12/1991 Ohno ..... 164/122.1

* cited by examiner

*Primary Examiner* — Brian Walck

(74) *Attorney, Agent, or Firm* — Joseph D. Eng, Jr.; King & Spalding LLP

(57) ABSTRACT

This invention discloses an L,R,C method and equipment for casting amorphous, ultracrystallite and crystallite metal slabs or other shaped metals. A workroom (8) with a constant temperature of $t_b$=−190° C. and a constant pressure of $p_b$=1 bar, and liquid nitrogen of −190° C. and 1.877 bar is used as a cold source for cooling the casting blank. A liquid nitrogen ejector (5) ejects said liquid nitrogen to the surface of ferrous or non-ferrous metallic slabs or other shaped metals (7) with various ejection quantity v and various jet velocity k. Ejected liquid nitrogen comes into contact with the casting blank at cross section c shown in FIG. 2. This method adopts ultra thin film ejection technology, with a constant thickness of said film at 2 mm and ejection speed $K_{max}$ of said liquid nitrogen at 30 m/s. During the time interval Δτ; corresponding to different cooling rates $V_k$, a guiding traction mechanism (6) at different continuous casting speed u pulls different lengths Δm of metal from the outlet of the hot casting mold (4). Under the action of heat absorption and gasification of ejected liquid nitrogen, molten metal is solidified and cooled rapidly to form an amorphous, ultracrystallite or crystallite metal structure.

6 Claims, 2 Drawing Sheets

L, R, C METHOD AND EQUIPMENT FOR CONTINUOUS CASTING AMORPHOUS, ULTRACRYSTALLITE AND CRYSTALLITE METALLIC SLAB OR STRIP

TECHNICAL FIELD OF THE INVENTION

The invention relates to producing amorphous, ultracrystallite or crystallite structure of ferrous and nonferrous alloys by using the technique of rapid solidification, the technique of a low temperature workroom, low temperature liquid nitrogen ejection at high speed and an extremely thin liquid film ejection, and the technique of continuous casting.

EXISTING TECHNIQUES PRIOR TO THE INVENTION

The tensile strength of amorphous metal is higher than that of common metal and a little lower than that of metal filament. The strength of iron filament with a diameter of 1.61 μm reaches 13400 Mpa, which is over 40 times higher than that of industry pure iron. At present, the amorphous metal with highest strength is $Fe_{80}B_{20}$, and its strength reaches 3630 Mpa. Besides high strength, amorphous metal also has high toughness and special physical properties, such as super conduction property, anti-chemical corrosion property etc. However, in normal conditions, the Young's modulus and shear modulus of amorphous metal are about 30%-40% lower than those of crystal metal, and the Mozam ratio v is high—about 0.4. The tensile strength of amorphous metal greatly depends on temperature. An obvious softening phenomenon appears at the temperature which is near the amorphous transformation temperature $T_g$. When liquid Al—Cu alloy is sprinkled on a strong cooling base, the cooling rate of the alloy reaches $10^{6\circ}$ C./S. After solidification, alloy grains obtained have dimensions of less than 1 μm, with tensile strength over 6 times higher than that of the alloy produced by a common casting method. The dimension of a fine grain is 1~10 μm, resulting in a very detailed microstructure in the fine grain and a great improvement to the mechanical properties of the fine grain.[1][2][3]

Obviously, producing different brands of amorphous, ultracrystallite and crystallite metallic slabs or other shaped metals of ferrous and nonferrous metal by the method of rapid solidification is very important in civil, military and aerospace industries. However, at present, none of the ferrous or nonferrous companies in the world can do it. The main reasons for this are as follows:

1. The cold source is not strong enough. Generally, the working media of the cold source are air or water, and the working temperature is of atmospheric environment.
2. In the method of continuous casting and directional solidification, the temperature of molten metal is only made to fall rapidly when passing through the liquid-to-solid phase-change region. After solidification, low speed cooling is used. As a result, the temperature of the metal is still very high after solidification. When the dimension of the metal being cast increases, the heat resistance to heat transfer increases, and so is the difficulty of heat dissipation. Rapid solidification cannot proceed.

THE TECHNIQUES OF THE INVENTION

The name of the invention is "the L,R,C method and equipment for casting amorphous, ultracrystallite, crystallite metallic slabs or other shaped metals".

L—represents low temperature. "L" is the first letter of "Low temperature".

R—represents rapid solidification. "R" is the first letter of "Rapid solidification".

C—represents continuous casting. "C" is the first letter of "Continuous casting" (Translator note: this was written in English in the Chinese version as "Continuous foundry".)

The equipment is a continuous casting machine and the system thereof. The product produced by the L,R,C method and continuous casting system is a metallic slab or other shaped metal of amorphous, ultracrystallite, crystallite, or fine grain. In other words, a metallic slab or other shaped metal of amorphous, ultracrystallite, crystallite or fine grain of ferrous and nonferrous metal can be produced for different brands and specifications using the method of low temperature and rapid solidification with a continuous casting system.

The threshold cooling rate $V_k$ to form metal structures of amorphous, crystallite, and fine grain depends on the type and chemical composition of the metal. According to the references, it is generally considered that:

When molten metal is solidified and cooled at cooling rate $V_K$, $V_K \geq 10^{7\circ}$ C./S, amorphous metal can be obtained after solidification. The latent heat L released during solidification of molten metal is =0;

When molten metal is solidified and cooled at cooling rate $V_K$ between $10^{4\circ}$ C./S and $10^{6\circ}$ C./S, crystallite metal can be obtained after solidification. The latent heat L released during solidification of molten metal is ≠0;

When molten metal is solidified and cooled at cooling rate $V_K=10^{4\circ}$ C./S, fine grain metal can be obtained after solidification. The latent heat L released during solidification of molten metal is ≠0.

To facilitate the analysis, after the type and the composition of the metal is determined, the production parameters can be calculated according to the range of metal cooling rate $V_k$ used to get the metal structures of amorphous, crystallite, or fine grain. After a production experiment, the production parameters can be modified according to the results.

When molten metal is solidified and cooled at cooling rate $V_K=10^{7\circ}$ C./S or $V_K=10^{6\circ}$ C./S, a metal structure of amorphous or a metal structure of crystallite can be obtained respectively after solidification. If molten metal is solidified and cooled at cooling rate $V_K$ between $10^{6\circ}$ C./S to $10^{7\circ}$ C./S, a new metal structure, which is between amorphous metal structure and crystallite metal structure, is obtained, and the new metal structure is named ultracrystallite metal structure herein by the inventor. The estimated tensile strength of the new metal structure should be higher than that of crystallite metal structure and should approach the tensile strength of amorphous metal as the cooling rate $V_K$ increases. However, the Young's modulus, shear modulus and Mozam ratio v of the new structure should approach those of crystallite metal. The tensile strength of the new metal structure is independent of temperature. It can be expected that a metallic slab or other shaped metal of ultracrystallite structure should be a new and more ideal metallic slab or other shaped metal. The present invention will recognize this by doing more experiments and researches in order to develop a new product.

The principle of using the L,R,C method and its continuous casting system to cast metallic slabs or other shaped metals of amorphous, ultracrystallite, crystallite and fine grain are as follows: In order to better describe it, metallic slabs will be used as an example. According to the requirements for producing different types of ferrous and nonferrous metal, different specifications of metallic slabs and different requirements for getting amorphous, ultracrystallite, crystallite, and fine grain structures, the invention provides complete calculating methods, formulae and programs to determine all kinds of important production parameters. The invention also provides the way of using these parameters to design and make continuous casting system to produce the above-mentioned metallic slabs. When using the L,R,C method and its continuous casting system to cast metallic slabs or other shaped metals of amorphous, ultracrystallite, crystallite and fine grain, if we make the shape and dimension of the outlet's cross sections of the hot casting mould (4) shown in FIG. 1 and FIG. 2 the same as those of a desired metallic slab or other shaped metal, the desired metallic slab or other shaped metal can be produced. The production parameters can be determined according to the calculating methods, formulae and calculating programs of metallic slabs or shaped metals.

FIG. 1 is the schematic diagram of the L,R,C method and its continuous casting system used to cast metallic slabs or other shaped metals of amorphous, ultracrystallite, crystallite and fine grain. The size of an airtight workroom (8) with low temperature and low pressure is determined according to the specification of the metallic slab or other shaped metal, and the equipment and devices in the workroom. Firstly, switch on the low temperature refrigerator with three-component and compound refrigeration cycle to drop the room temperature to −140° C., then use other liquid nitrogen ejection devices (not shown in FIG. 1) which do not include liquid nitrogen ejection device (5), to eject the right amount of liquid nitrogen to further drop the room temperature to −190° C. and maintain the room temperature with the workroom pressure P being a little higher than 1 bar. The shape and dimension of the outlet's cross sections of hot casting mould (4) depend on that of the cross sections of metallic slabs or other shaped metals to be produced. Molten metal is poured into the mid-ladle (2) continuously by a casting ladle on the turntable (1). Molten metal (3) is kept at the level shown.

FIG. 2 is a schematic diagram to show the process of molten metal's rapid solidification and cooling at the outlet of the hot casting mould. The electric heater (9) heats up the hot casting mould (4) so that the temperature of the hot casting mould's inner surface, which is in contact with molten metal, is a little higher than the temperature of molten metal's liquidus temperature. As a result, molten metal will not solidify on the inner surface of the hot casting mould. When starting to cast a metallic slab of amorphous, ultracrystallite, crystallite and fine grain continuously using L,R,C method, the first thing to do is to turn the liquid nitrogen ejector (5) on and continuously eject fixed amounts of liquid nitrogen to traction bar (the metallic slab) (7) whose temperature is −190° C. As shown in FIG. 2, the location where the liquid nitrogen being ejected comes into contact with the metallic slab is set at the Cross Section C of the outlet of the hot casting mould. Then, the guidance traction device (6) shown in FIG. 1 is started immediately, and draws the traction bar (7) towards the left as shown in FIG. 1 at a continuous casting speed u. A thin metal minisection of Δm long is drawn out in a time interval Δτ. In order to continuously cast amorphous, ultracrystallite, crystallite and fine grain metallic slabs, molten metal in the minisection of Δm long is solidified and cooled at the initial temperature $t_1$ until ending temperature $t_2$, at the same cooling rate $V_k$ in this whole process. The $V_k$ for an amorphous, ultracrystallite, crystallite or fine grain metal structure is $10^{7\circ}$ C./S, $10^{6\circ}$ C./S~$10^{7\circ}$ C./S, $10^{4\circ}$ C./S~$10^{6\circ}$ C./S, $10^{4\circ}$ C./S respectively, where:

$t_1$—represents the initial solidification temperature of molten metal, ° C.;

$t_2$—represents the ending cooling temperature, ° C. $t_2$=−190° C.

For the different cooling rates $V_k$, mentioned above and molten metal within a length of Δm, the time interval Δτ required for cooling from the initial temperature $t_1$ until ending temperature $t_2$ can be calculated by the following formula:

$$\Delta\tau = \frac{\Delta t}{Vk}\ \text{s} \tag{1}$$

wherein $\Delta t = t_1 - t_2$.

The meaning of each symbol has been explained previously.

For a 0.23C low carbon steel, $t_1$=1550° C., $t_2$=−190° C. The time interval Δτ required for rapid solidification and cooling in continuous casting of amorphous, ultracrystallite, crystallite and fine grain metal structures are calculated and the results are listed in table 1.

TABLE 1

Δ τ REQUIRED FOR RAPID SOLIDIFICATION OF DIFFERENT METAL STRUCTURES

| Metal structure | Amorphous | Ultracrystallite | Crystallite | Fine grain |
|---|---|---|---|---|
| Δ τ s | $1.74 \times 10^{-4}$ | $1.74 \times 10^{-3}$~ $1.74 \times 10^{-4}$ | $1.74 \times 10^{-1}$~ $1.74 \times 10^{-3}$ | $1.74 \times 10^{-1}$ |

If the time interval Δτ for drawing out a length of Δm is the same as the time interval Δτ for, molten metal of length Δm to rapidly solidify and cool to form amorphous, ultracrystallite, crystallite and fine grain metal structures, and in the same time interval Δτ, by using gasification to absorb heat, the ejected liquid nitrogen absorbs all the heat produced by molten metal of length Δm during rapid solidification and cooling from initial temperature $t_1$ to ending temperature $t_2$, the molten metal of length Δm can be rapidly solidified and cooled to form amorphous, ultracrystallite, crystallite and fine grain structures in the thin metal minisection. In the section with a length of Δm shown in FIG. 2, on the right side of Cross Section A there is molten metal, and cross section b-c is the minisection of the metal which has just left the outlet of the hot casting mould and solidified completely. It can be seen from table 1 that the time interval Δτ of rapid solidification to form amorphous structure of 0.23C carbon steel is only $1.74\times10^{-4}$ S, and the time interval Δτ to form fine grain metal structure is only $1.74\times10^{-1}$ S too. In such a short time interval Δτ, the length of Δm being continuously cast is also of very minimal value. The following calculations show that the Δm for 0.23C amorphous carbon steel is only 0.03 mm, the Δm for ultracrystallite carbon steel is between 0.03 mm and 0.09 mm, the Δm for crystallite carbon steel is between 0.09 mm and 0.3 mm, and the Δm for fine grain is 0.9 mm. According to the theory of heat conduction of flat slabs, if both the length and width exceed the thickness by 10 times, the heat conduction can be deemed to be one dimensional stable-state heat conduction in engineering. That is to say, in using the L,R,C method to continuously cast 0.23C amorphous steel slabs, if all the dimensions of the section are greater than 0.3 mm; and in using the L,R,C method to continuously cast 0.23C ultracrystallite steel slabs, if all the dimensions of the section are greater than 0.3 mm~0.9 mm; in using the L,R,C method to continuously cast 0.23C crystallite steel slabs, if all the dimensions of the section are greater than 0.9 mm~3 mm, then heat conduction between Cross Section A and Cross Section C can be considered as one-dimensional stable-state heat conduction. Cross Section a, Cross Section b, Cross Section C and any other sections parallel to them are isothermal surfaces.

FIG. 3 shows the temperature distribution during rapid solidification and cooling of molten metal at the outlet of the hot casting mould. The ordinate is temperature, ° C., and the abscissa is distance, Xmm. Under the powerful cooling action caused by gasification of ejected liquid nitrogen, the temperature of molten metal on Cross Section a falls to initial solidification temperature $t_1$, which is the liquidus temperature of the metal. The temperature of metal on Cross Section b falls to the metal's solidification temperature $t_s$, which is the solidus temperature of that metal. The location of Cross Section b is set at the outlet of the hot casting mould. This location can be adjusted through the time difference between the start of liquid nitrogen ejector (5) and the start of guidance traction mechanism (6). The segment with a length of ΔL between Cross Section a and Cross Section b is a region where liquid-solid coexist, and the segment between Cross Section b and Cross Section c is a region of solid state. The temperature of metal at Cross Section c is the solidification ending temperature $t_2$, which is −190° C. As the process of heat conduction in the whole section with a length of Δm is one-dimensional stable-state heat conduction, the temperature distribution of the metal between Cross Section a and Cross Section c should have a linear feature as shown in FIG. 3. It can be seen that Cross Section b is an interface of solid-liquid state of metal. As metal solidifies on Cross Section b, it is drawn out immediately. Newly molten metal continues to solidify on Cross Section b, and thus amorphous, ultracrystallite, crystallite or fine grain metallic slab can be continuously cast. The solidified metal does not have contact with the hot casting mould. They are kept with each other by the interfacial tension of molten metal and so there is no friction between solid metal and the hot casting mould. This makes it possible to cast metallic slabs with smooth surfaces. On the other hand, as the process of using the L,R,C method to cast amorphous, ultracrystallite, crystallite or fine grain metallic slab proceeds steadily and continuously, the length of the metallic slab being cast continues to increase. However, both the location and temperature of Cross Section c is unchanged: $t_2$ is still −190° C. Thus, the thermal resistance of the solid metal would not increase, the process of rapid solidification and cooling would not be affected, and the cooling rate $V_k$ of molten metal and solid metal with a length of Δm remains unchanged from the beginning to the end. In addition, to facilitate the description, the length Δm shown in FIG. 2 and FIG. 3 is for illustration and has been magnified. A powerful exhaust system (not shown in FIG. 1, and FIG. 2) is to be set up on the left facing the liquid nitrogen ejector (5) to rapidly release from the workroom all the nitrogen gas produced by gasification of the ejected liquid nitrogen after heat absorption. This ensures that the temperature in the workroom is maintained at a constant temperature of −190° C. and the pressure at a constant a little higher than 1 bar.

DESCRIPTION OF THE ATTACHED DRAWINGS

EMBODIMENT

1. In determining the formulae for calculating the production parameters of the L,R,C method and its continuous casting system.

1) Determine the cooling rate $V_k$

See above for determining the cooling rate $V_k$ from the production of amorphous, ultracrystallite, crystallite or fine grain metallic slabs.

2) Determine the time interval Δτ of rapid solidification and cooling

See above.

$$\Delta\tau = \frac{\Delta t}{Vk}\ \mathrm{s} \tag{1}$$

3) Determine the length Δm of continuous casting in the time interval Δτ

As the heat conduction between Cross Section a and Cross Section c is a one-dimensional stable-state heat conduction, the quantity of heat conduction between Cross Section a and Cross Section b is calculated by the following formula.

$$Q_1 = \lambda c_P A \frac{\Delta t}{\Delta m}\ w \tag{2}$$

Where:

$\lambda_{CP}$—average thermal conductivity W/m·° C.[appendix1]

A—area of the cross section perpendicular to the direction of heat conduction $m^2$ Δt—temperature difference between Cross Sections a and c $\Delta t = t_1 - t_2$ ° C.

Δm—distance between Cross Sections a and c m

In the time interval Δτ, which corresponds to the cooling rate $V_k$ in getting amorphous, the quantity of heat conduction from Cross Sections a to c is $\Delta Q_1$.

$$\Delta Q_1 = Q_1 \Delta\tau \quad \mathrm{KJ}$$

Substituting the Δτ in formula (1) into the above formula, $$\Delta Q_1 = Q_1 \frac{\Delta t}{Vk}\ KJ \tag{3}$$

Figure 2:
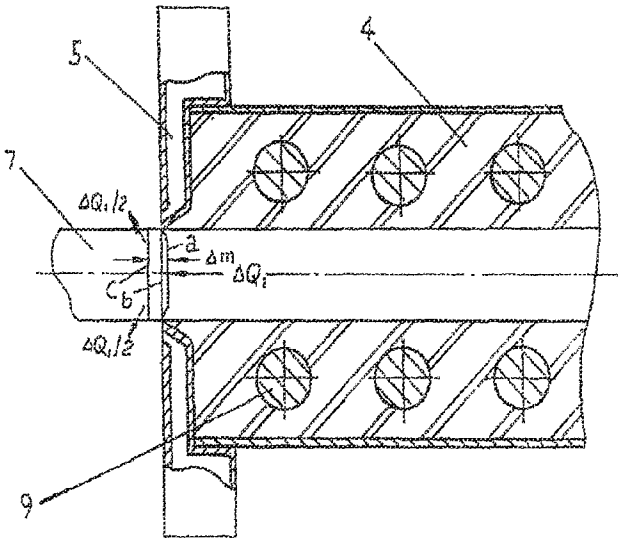
FIG. 2 is a drawing that illustrates the principle of molten metal's rapid solidification and cooling process at the outlet of the hot casting mould.

FIG. 2 shows the quantity of heat $\Delta Q_1$ which conducts from Cross Section a to c, and the quantity of heat $\Delta Q_1/2$ which conducts to the top or bottom surface of the slab. If the liquid nitrogen ejected to the top and the bottom surface of the slab can absorb the quantity of heat $\Delta Q_1$ through gasification in the time interval Δτ, which corresponds to the cooling rate $V_k$ for getting amorphous, amorphous metallic slabs with a length and a thickness of Δm and E respectively can be cast. Ultracrystallite, crystallite, or fine grain metallic slabs with a length of Δm can be cast according to the same principle. $\Delta Q_1$ is the quantity of heat which is absorbed by the ejected liquid nitrogen through gasification in the time interval $\Delta\tau$, and so $\Delta Q_1$ is the basis for calculating the quantity of liquid nitrogen ejected in the time interval $\Delta\tau$.

In the same time interval $\Delta\tau$, molten metal in Cross Section a moves to Cross Section c where metal cooling has ended. The internal heat energy in molten metal with length $\Delta m$ and thickness E should be:

$$\Delta Q_2 = A\Delta m\rho_{CP}(C_{CP}\Delta t + L) \quad \text{KJ (4)}$$

Where

A—area of the cross section perpendicular to the direction of heat conduction $m^2$

A=B×E

B—width of metallic slab m

E—thickness of metallic slab m $\Delta m$—length of metal with thickness E which is continuously cast in the time interval $\Delta\tau$, i.e. distance between Cross Section a and Cross Section c m $\rho_{CP}$—average density of metal $g/cm^3$ [appendix 1]

$C_{CP}$—average specific heat KJ/Kg° C. [appendix 1]

$\Delta t$—the temperature difference between Cross Sections a and c $\Delta t = t_1 - t_2$° C.

L—latent heat of metal KJ/Kg

For amorphous metal, $V_K \geq 10^7$° C./S, L=0

$$\Delta Q_2 = BE\Delta m\tau_{CP}C_{CP}\Delta t \quad \text{KJ (5)}$$

For ultracrystallite, crystallite or fine grain metal structure $L \neq 0$ $$\Delta Q_2 = BE\Delta m\tau_{CP}(C_{CP}\Delta t + L) \quad \text{KJ (6)}$$

If $\Delta Q_1 > \Delta Q_2$, the heat absorbed by ejected liquid nitrogen is more than internal heat energy in molten metal with length $\Delta m$ and thickness E. As shown in FIG. 2, in the mid-ladle, the heat of molten metal on the right of Cross Section a at the outlet of the hot casting mould (4) would conduct to Cross Section c so as to compensate for the deficiency of internal heat energy of molten metal with length $\Delta m$. Thus, Cross Section b will gradually move towards the right, and finally the outlet of the hot casting mould (4) would be filled with solidified metal, which would stop the continuous casting. There are two ways to solve this problem. One of them is to increase the continuous casting speed u and $\Delta m$ so that $\Delta Q_1$ decreases and $\Delta Q_2$ increases, until $\Delta Q_1 = \Delta Q_2$. However this is subject to the limitation of the traction device (6). Another way is to increase the power of the electric heater (9) to compensate for the deficiency of heat for $\Delta Q_2$. However, as additional energy is required, this is obviously not economical.

If $\Delta Q_1 < \Delta Q_2$, internal heat energy in molten metal with length $\Delta m$ and thickness E is more than the heat absorbed by ejected liquid nitrogen, part of internal heat energy would remain in molten metal with length $\Delta m$, which would affect the rapid solidification and cooling processes. In order to get the expected result of rapid solidification and cooling, the continuous casting speed u and length $\Delta m$ must be reduced so that $\Delta Q_1$ increases and $\Delta Q_2$ decreases, until $\Delta Q_1 = \Delta Q_2$.

If $\Delta Q_1 = \Delta Q_2$, in producing amorphous metal in the time interval $\Delta\tau$ corresponding to cooling rate $V_k$, ejected liquid nitrogen takes away the quantity of heat $\Delta Q_1$ which conducts from Cross Section a to c. $\Delta Q_1$ is exactly all the internal heat energy $\Delta Q_2$ in molten metal with length and thickness $\Delta m$ and E respectively. Then, molten metal with length $\Delta m$ would be rapidly solidified and cooled at the predetermined cooling rate $V_k$, producing the expected amorphous metallic slabs. By the same token, in producing ultracrystallite, crystallite or fine grain metal, if in the time interval $\Delta\tau$ corresponding to cooling rate $V_k$, the quantity of heat absorbed $\Delta Q_1 = \Delta Q_2$, molten metal with length $\Delta m$ and thickness E would form the expected ultracrystallite, crystallite or fine grain metallic slabs.

Let $\Delta Q_1 = \Delta Q_2$, substitute $\Delta Q_1$ in formula (3) and $\Delta Q_2$ in formula (4):

$$\lambda_{CP}A\frac{\Delta t}{\Delta m}\Delta\tau = A\Delta m\rho_{CP}(C_{CP}\Delta t + L) \quad (7)$$

$$\Delta m = \sqrt{\frac{\lambda_{CP}\Delta t\Delta\tau}{\rho_{CP}(Ccp\Delta t + L)}} \text{ mm}$$

For amorphous metal, L=0

$$\Delta m = \sqrt{\frac{\lambda_{CP}\Delta\tau}{\rho_{CP}C_{CP}}} \text{ mm} \quad (8)$$

$$\Delta m = \sqrt{\alpha_{CP}\Delta\tau}$$

Where $\alpha_{CP}$—the average thermal conductivity coefficient of metal $$\alpha_{CP} = \frac{\lambda_{CP}}{\rho_{CP}C_{CP}} \text{ m}^2/\text{s}$$

For ultracrystallite, crystallite or fine grain metal structure, substitute $$\Delta\tau = \frac{\Delta t}{V_k}$$

into formula (7):

$$\Delta m = \sqrt{\frac{\lambda_{CP}}{\rho_{CP}(C_{CP}\Delta t + L)V_K}} \cdot \Delta t \text{ mm} \quad (9)$$

Formulae (6), (7) and (8) show that $\Delta m$ depends on parameters such as $\lambda_{CP}$, $\rho_{CP}$, $C_{CP}$, L, $\Delta t$ and $\Delta\tau$, wherein $\lambda_{CP}$, $\rho_{CP}$, $C_{CP}$ and L all being physical parameters of metal, and $\Delta t = t_1 - t_2$, wherein $t_1$ being the initial solidification temperature and $t_2$ being the cooling ending temperature, which is a constant −190° C. So, $\Delta t$ can also be considered as a physical parameter of metal. These parameters can be determined once the composition of a metallic slab is determined. On the other hand $\Delta\tau$ depends on the metal structure of the slab being produced. For example, if it is decided to produce slabs of amorphous metal structure, the cooling rate $V_k$ is equal to $10^7$° C./S, $V_k$ is thus determined. This indicates that $\Delta\tau$ is determined once the composition and the structure of metal to be produced are determined. It can be seen that $\Delta m$ depends on two factors. One is the type and composition of the metal and the other is the required metal structure.

4) Determine the continuous casting speed u

For amorphous, ultracrystallite, crystallite and fine grain metal structures, the continuous casting speed u can be obtained from the following formula.

$$u = \frac{\Delta m}{\Delta \tau} \text{ m/s} \tag{10}$$

5) Determine the quantity V of ejected liquid nitrogen

In order to produce slabs of amorphous, ultracrystallite, crystallite or fine grain metal structure, in the time interval $\Delta\tau$ corresponding to the required metal structure, $\Delta V$ amount of ejected liquid nitrogen must be able to absorb all the internal heat energy $\Delta Q_2$ of molten metal with thickness E and length $\Delta m$ by gasification. Accordingly, the quantity $\Delta V$ of liquid nitrogen ejected in the time interval $\Delta\tau$ can be calculated with the following formula:

$$\Delta V = \frac{\Delta Q_2}{r} V' \text{ dm}^3 \tag{11}$$

Where $\Delta V$—quantity of liquid nitrogen ejected in the time interval $\Delta\tau$ $dm^3$ r—latent heat of liquid nitrogen the heat energy that 1 Kg of liquid nitrogen absorbed to become gas in the condition of p=1.877 bar, t=−190° C. KJ/Kg V' specific volume of liquid nitrogen volume of 1 Kg liquid nitrogen in the condition of p=1.877 bar and t=−190 $dm^3$/Kg[appendix 2]

$\Delta Q_2$—internal energy in the molten metal with thickness E and length $\Delta m$ in the time interval $\Delta\tau$, which is the quantity of heat $\Delta Q_1$ that conducts form Cross Section a to Cross Section c KJ For amorphous metal, $\Delta Q_2$ can be calculated with formula (5).

For ultracrystallite, crystallite, or fine grain metal, $\Delta Q_2$ can be calculated with formula (6).

Values of r and V' can be found in Appendix 2. With r and V', $\Delta V$ can be calculated using formula (11). Once $\Delta V$ is determined, the quantity of ejected liquid nitrogen V can be calculated with the following formula:

$$V = \frac{\Delta V}{\Delta \tau} \cdot 60 \text{ dm}^3/\text{min} \tag{12}$$

Where V is the quantity of ejected liquid nitrogen $dm^3$/min

6) Determine the thickness h of the ejected liquid nitrogen layer

The thickness h of the ejected liquid nitrogen layer on the top or bottom surface of the metallic slab can be calculated with the following formula:

$$h = \frac{\Delta V}{2BK\Delta \tau} \text{ mm} \tag{13}$$

where:

h—thickness of ejected liquid nitrogen layer mm

K—ejection speed of liquid nitrogen m/s

B—width of the top and bottom surface plus the converted thickness of the two sides mm $\Delta V$ and $\Delta\tau$ as above 7) Determine the volume Vg of gas produced by gasification of volume V of ejected liquid nitrogen After the parameters such as $\Delta Q_2$ and r are determined, V can be calculated with the following formula:

$$V_g = \frac{\Delta Q_2}{r} V'' \frac{60}{\Delta \tau} \text{ dm}^3/\text{min} \tag{14}$$

Where:

Vg—volume of nitrogen gas produced by the gasification of volume V of the ejected liquid nitrogen, in the condition of p=1.877 bar and t=−190° C. $dm^3$/min V"—volume of nitrogen gas produced by the gasification of 1 Kg liquid nitrogen in the condition of p=1.877 bar and t=−190° C. $dm^3$/Kg[appendix 2]

$\Delta Q_2$, r and $\Delta\tau$ as above.

The calculated Vg can be used to design the throughput of a powerful exhaust system.

2. Heat conduction within a metallic slab

As shown in FIG. 2, in the process of rapid solidification and cooling, the quantity of heat $\Delta Q_1$ must conduct from the inner of a metallic slab to its surface, and then be taken away from the surface of the slab through gasification of the liquid nitrogen ejected to the surface of the slab. However, can the quantity of heat conduct from the inside to surface of the slab quickly? If it can, then $\Delta Q_1$ does have the possibility of being taken away completely by ejecting liquid nitrogen to the surface of the slab. Obviously, the speed of heat conduction from the inside to the surface of the slab has become a limiting factor.

Because all cross sections a-c between and parallel to Cross Section a and Cross Section c are isothermal surfaces, all cross sections on the left of Cross Section c are also isothermal surfaces with a temperature of −190° C. When the quantity of heat inside the slab conducts through the above-said isothermal surfaces to the surface of the slab, according to the heat conduction formula:

$$\Delta t = QR_\lambda$$

Where:

Q—quantity of heat conducting through isothermal surfaces, its value depending on quantity of heat conduction of Cross Sections a-c. W $\Delta t$—temperature difference of heat conduction between the isothermal surfaces ° C.

$R_\lambda$—thermal resistance of heat conduction in the isothermal surfaces ° C./W As there is no temperature difference in isothermal surfaces, $\Delta t=0$. Quantity of heat conduction Q depends on $\Delta Q_2$, which means Q depends on the quantity of ejected liquid nitrogen. Therefore, $Q\neq 0$, $R_\lambda$ must be zero, and so $R_\lambda=0$.

$R_\lambda=0$ infers that when heat conducts through isothermal surfaces from the inside to surface of a slab, there is no thermal resistance in the heat conduction. The metal on the left of Cross Section c is an isothermal surface with a temperature of −190° C., and there is no any thermal resistance for inner heat conducting to the slab surface in any direction. Therefore, on the left of Cross Section c, when the heat inside the slab conducts to the slab's surface, it can conduct completely to the slab's surface duly and rapidly without affecting heat absorption of ejected liquid nitrogen on the slab surface.

3. Application of liquid nitrogen in the L,R,C method and its continuous casting system Liquid nitrogen is a colorless, transparent and easy-flowing liquid with the properties of a common fluid. In a liquid nitrogen ejecting system, the pressure p and the flowing speed V can be controlled using a common method. When liquid nitrogen approaches its threshold state, abnormal changes of its physical properties will occur, especially the peak value of specific heat $C_p$ and thermal conductivity λ. However, in the process of rapid solidification and cooling, ejected liquid nitrogen is not operating in its threshold region. Thus it is not necessary to consider the abnormal change in its physical properties in threshold state. The standard boiling point of liquid nitrogen is $t_{boil}$=−195.81° C., in p=1.013 bar[appendix 2].

In other studies, when carbon steel is stirred and quenched directly in liquid nitrogen, its hardness is far lower than that of carbon steel quenched in water[4]. The phenomenon indicates that when a red-hot part is put into liquid nitrogen in a large vessel, liquid nitrogen will absorb heat and gasify rapidly. The nitrogen gas produced in the large vessel will surround the part, thus forming a nitrogen gas layer that separates the part from liquid nitrogen. The gas layer does not conduct heat and becomes a heat insulating layer for the part. As a result, the heat does not dissipate well, the cooling rate drops and the hardness of carbon steel quenched in liquid nitrogen is much lower than that of carbon steel quenched in water.

At pressure p=1 bar, the water in a large vessel is heated until boiling starts, and then the temperature distribution in the water is measured. In the thin water layer of 2-5 mm thickness immediately next to the heating surface, the temperature rises sharply from about 100.6° C. to 109.1° C. Because of the rapid temperature change, a vast temperature gradient close to the wall appears in the water. However, the water temperature outside the thin layer does not vary much. The vast temperature gradient close to the wall makes the boiling heat transfer coefficient $\alpha_c$ of the water far higher than the convective heat transfer coefficient of the water without phase changing. An important conclusion can be drawn from this that the heat transfer from the heating surface to the water and the gasification of the water mainly take place in the thin water layer of 2-5 mm thickness, and the water outside the thin water layer has little effect on that. Furthermore, it is found that such property of vast temperature gradient in the thin layer close to the heating surface exists in all other boiling processes. People begin to use heating methods such as shallow pools, with liquid depth not exceeding 2-5 mm, and flow boiling with the fluid's thickness within 2-5 mm. Both of them produce a more significant temperature gradient close to the wall. This kind of boiling in a low liquid level is called liquid film boiling. As for flow boiling of thin liquid film, because of the effect of the liquid's flow speed, the temperature gradient close to the wall is even larger, resulting in an even higher heat transfer capability of this kind of flow boiling of thin liquid film. In order to utilize the effect of high flow speed, some studies use water at high flow speed of 30 m/s, flowing into a cylindrical pipe with a diameter of 5 mm, achieving $q_w=1.73\times10^8$ W/m$^2$ [5].

Based on the analysis for the above data, the L,R,C method uses the technology of ejection heat transfer with high ejection speed and extremely thin liquid film. In the following formula:

$$h = \frac{\Delta V}{2BK\Delta\tau} \text{ mm} \tag{13}$$

The meaning of the symbols in the formula is provided above.

After determining Δτ and ΔV, raising liquid nitrogen's ejection speed K to 30 m/s or higher and keeping the ejected liquid nitrogen layer's thickness h within 2-3 mm or even 1-2 mm can realize high ejection speed and extreme thin liquid film ejection technology.

At the outlet of the liquid nitrogen ejector (5) shown in FIG. 2, the parameters relating to ejected liquid nitrogen and workroom (8) are as follows:

p—liquid nitrogen's ejection pressure p=1.887 bar t—temperature of liquid nitrogen t=−190° C.

Kmax—liquid nitrogen's maximum ejection speed Kmax=30 m/s h—thickness of ejected liquid nitrogen layer h=2~3 mm or 1-2 mm $P_b$—pressure of the workroom $P_b$=1 bar $t_b$—temperature of the workroom $t_b$=−190° C.

Liquid nitrogen is ejected from the ejector (5)'s outlet, which has a height of 2-3 mm or 1-2 mm, into the whole of the workroom space. Since the jet stream of liquid nitrogen is very thin and the its speed is extremely high, when the jet beam reaches the slab after a short distance, the pressure of the whole cross section of the jet beam from edge to center drops rapidly from 1.887 bar to 1 bar. At this pressure, the saturated temperature of liquid nitrogen is also its boiling temperature $t_{boil}$, $t_{boil}$=−195.81° C.[appendix 2]. However, the temperature of ejected liquid nitrogen is still t=−190° C., which is higher than the boiling temperature. So, liquid nitrogen is in the boiling state. When heat conducts therein, liquid nitrogen can be gasified rapidly. The gasification speed relates to the temperature difference between the liquid nitrogen's temperature and the boiling point temperature. At present, the temperature difference is 5.75° C. If the temperature difference further increases, the speed of liquid nitrogen's gasification will be even higher.

When the above mentioned ejected liquid nitrogen's pressure falls from 1.887 bar to 1 bar, the liquid nitrogen's temperature is still higher than the saturated temperature (boiling point temperature) at pressure 1 bar[6]. This conforms to the physical condition of volume boiling. As long as the heat supply is sufficient, equal phase gasification will occur to the whole of the ejected liquid nitrogen layer instantly. Naturally, a nitrogen gas layer isolating ejected liquid nitrogen will not occur.

The liquid nitrogen's flowing speed is set up at up to 30 m/s and the thickness of the ejected liquid nitrogen layer is controlled at only 2-3 mm, or even 1-2 mm. The purpose is to make the thin layer with high flowing speed to be exactly the thin layer which exhibits extremely high temperature gradient close to the wall. Thus, the whole thin layer of liquid nitrogen is within the extremely high temperature gradient close to the wall and takes part in the strong heat transfer. Furthermore, the high flowing speed makes the heat transfer even stronger, causing all liquid nitrogen in the thin layer to absorb heat and gasify. The evaporation produced in gasification is taken away rapidly by an exhaust system so that even in the bottom surface of a metal slab, there is no nitrogen gas layer to isolate ejected liquid nitrogen. It can be seen that the effects of rapid solidification and cooling from ejected liquid nitrogen are the same at the top or bottom surface. The temperature of the metal slab's surfaces also affects the temperature close to the wall and the strength of heat transfer.

From the above analysis, it can be seen that: in the L,R,C method and its continuous casting system, by using high ejection speed and extremely thin liquid film ejection technology, ejected liquid nitrogen through heat absorption and gasification takes away ΔQ of heat in the required time interval Δτ, without forming any nitrogen layer that isolates ejected liquid nitrogen on the metal slab's surface.

4. Heat exchange between ejected liquid nitrogen and metal slab

When the L,R,C continuous casting system begins casting, as shown in FIG. 2, ejected liquid nitrogen will come into contact with the metal slab at Cross Section c. In the beginning of casting, the temperatures of the metal slab and ejected liquid nitrogen are both −190° C. So at the beginning instant of the time interval Δτ, there is no heat exchange between liquid nitrogen and the metal slab. However, after an extremely short interval in the time interval Δτ, a small portion of the quantity of heat $\Delta Q_1/2$ gets transmitted to the slab's surface at the contact point. The temperature of the slab's surface immediately rises rapidly, thus creating a temperature difference between liquid nitrogen and the slab's surface. Liquid nitrogen begins to exchange heat with the slab's surface and takes away this portion of heat through gasification, so that the temperature of the slab's surface drops to −190° C. immediately. It is also in such an extremely short time interval that all nitrogen produced by gasification of liquid nitrogen ejected to the contact point is taken away from the workroom (8) by a powerful exhaust system. This extremely short time interval within the time interval Δτ is followed by another extremely short time interval, during which the metal slab moves left for another extremely short distance, New liquid nitrogen is then ejected onto the newly arrived portion of the slab's surface. Heat exchange between liquid nitrogen and the slab repeats itself in the above-mentioned process. After the time interval Δτ, ejected liquid nitrogen eventually takes away $\Delta Q_1/2$ of heat. Because a metal slab has a top and a bottom surface, ejected liquid nitrogen eventually takes away all $\Delta Q_1$. of heat. Rapid solidification and cooling will proceed as anticipated, eventually producing metallic slabs of amorphous, ultracrystallite, crystallite and fine grain metal structures.

It is possible that the actual situation of heat exchange between liquid nitrogen and a metallic slab is a little different from the above mentioned, and the final cooling ending temperature $t_2$ of a slab is 10-20° C. higher than −190° C., i.e. $t_2$=−180° C. 170° C. However, this will not affect the production of metallic slabs of amorphous, ultracrystallite, crystallite and fine grain metal structures. The final temperature of the metallic slab will still be 190° C.

Lastly, the working pressure of the workroom (8), $p_b$=1 bar, should be kept constant by a powerful air exhaust system. The working temperature $t_b$=−190° C. can be adjusted according to the results of a production trial.

5. Formulae for calculating production parameters in casting amorphous, ultracrystallite, crystallite and fine grain metal slabs with maximum thickness $E_{Max}$ The object in research is a metal slab with width B=1 m.

The thickness h of the ejected liquid nitrogen layer is determined as h=2 mm and kept constant. Under the dual action of an extremely high temperature gradient close to the wall and volume gasification of equal phase, which is caused by a pressure reduction of ejected liquid nitrogen, all the ejected liquid nitrogen layer with h=2 mm can absorb heat and gasify to produce amorphous, ultracrystallite, crystallite and fine grain metal slabs. If h>2 mm, slabs of metal structure cast may not meet the requirements. If h is kept constant at 2 mm, the ejection nozzle of the liquid nitrogen ejector (5) will not need to replace as its size is fixed.

The maximum ejection speed $K_{max}$ of liquid nitrogen is determined as $K_{max}$=30 m/s. When B=1 m, h=2 mm, and $K_{max}$=30 m/s, the liquid nitrogen ejector (5) ejects a maximum quantity of $V_{max}$ of liquid nitrogen. Under the action of this quantity of liquid nitrogen, amorphous, ultracrystallite, crystallite or fine grain metal slabs of maximum thickness $E_{max}$ can be continuously cast.

Detailed calculation as follows:

1) Determine cooling rate $V_k$

Different cooling rates $V_k$ are determined according to whether amorphous, ultracrystallite, crystallite or fine grain metal structure is required.

2) Calculate the time interval Δτ of rapid solidification and cooling

Δt is calculated with formula (1)

$$\Delta\tau = \frac{\Delta t}{V_K}\ \text{s} \tag{1}$$

3) Calculate the length Δm of slabs cast in the time interval Δτ

For amorphous metal structure, Δm is calculated with formula (8)

$$\Delta m = \sqrt{\frac{\lambda_{CP}}{\rho_{CP}C_{CP}}\Delta\tau}\ \text{mm} \tag{8}$$

For ultracrystallite, crystallite and fine grain metal structure, Δm is calculated with formula (9)

$$\Delta m = \sqrt{\frac{\lambda_{CP}}{\rho_{CP}(C_{CP}\Delta t + L)V_K}}\cdot\Delta\tau\ \text{mm} \tag{9}$$

4) Calculate the continuous casting speed u u is calculated with formula (10)

$$u = \frac{\Delta m}{\Delta t}\ \text{m/s} \tag{10}$$

Parameters Vk, Δτ, Δm, and u only depend on the thermophysical properties of metal and the different amorphous, ultracrystallite, crystallite and fine grain metal structures. They are independent of the thickness of a metal slab. After the type and composition of a metal and the desired metal structure are determined, the values of parameters Vk, Δτ, Δm, and u are also determined. Changing the thickness of a metal slab would not affect these values.

5) Calculate $\Delta V_{max}$

When the maximum ejection speed of liquid nitrogen $K_{max}$=30 m/s, the thickness of the ejected liquid nitrogen layer h=2 mm and the width of the metallic slab B=1 m are kept constant, $\Delta V_{max}$ is the volume of liquid nitrogen ejected by liquid nitrogen ejector (5) in the time interval Δτ. This volume of ejected liquid nitrogen is the maximum volume of ejected liquid nitrogen in the time interval Δτ. $\Delta V_{max}$ can be calculated with formula (13). Substitute ΔV with $\Delta V_{max}$ in formula (13) to become formula (15), from which $\Delta V_{max}$ can be calculated.

$$\Delta V\text{max}=2BK\text{max}\Delta\tau h\ \text{dm}^3 \tag{15}$$

6) Calculate $\Delta Q_{2max}$ $\Delta Q_{2max}$ is the quantity of heat absorbed by the maximum ejection volume $\Delta V_{max}$ of liquid nitrogen during complete gasification. Substitute ΔV and ΔQ with $\Delta V_{max}$ and $\Delta Q_{2max}$ respectively in formula (11) to become formula (16), from which the value of $\Delta Q_{2max}$ can be calculated.

$$\Delta Q_{2max} = \frac{\Delta V_{max} r}{V'} KJ \tag{16}$$

7) Calculate the maximum thickness $E_{max}$ of an amorphous, ultracrystallite, crystallite or fine grain metal slab $Q_{2max}$ is the maximum ejection volume $\Delta V_{max}$ of liquid nitrogen during complete gasification, and is also the internal heat energy contained in molten metal of an amorphous, ultracrystallite, crystallite or fine grain metal slab with length Δm. Therefore, the maximum thickness $E_{max}$), can be calculated with the following formulae.

For amorphous metal slabs, substitute $\Delta Q_2$ and E with $\Delta Q_{2max}$ and $E_{max}$ respectively in formula (5) to become formula (17), from which the value of $E_{max}$ can be calculated.

$$E_{max} = \frac{\Delta Q_{2max}}{B\Delta m \rho_{CP} C_{CP} \Delta t} \text{ mm} \tag{17}$$

For ultracrystallite, crystallite or fine grain metal slabs substitute $\Delta Q_2$ and E with $\Delta Q_{2max}$ and $E_{max}$ respectively in formula (6) to become formula (18), from which the value of $E_{max}$ can be calculated.

$$E_{max} = \frac{\Delta Q_{2max}}{B\Delta m \rho_{CP}(C_{CP}\Delta t + L)} \text{ mm} \tag{18}$$

8) Calculate $V_{max}$

Substitute V and ΔV with $\Delta Q_{2max}$ and $E_{max}$ respectively in formula (12) to become formula (19), from which the value of $V_{max}$ can be calculated.

$$V_{max} = \frac{\Delta V_{max}}{\Delta \tau} \cdot 60 \text{ dm}^3/\text{min} \tag{19}$$

Substitute formula (15) into the above formula:

$$V_{max} = 120BK_{max}h \text{ dm}^3/\text{min} \tag{19'}$$

When B, $E_{max}$ and h are constant, $E_{max}$ is also constant.

9) Calculate $V_{gmax}$

Substitute $V_g$ and $\Delta Q_2$ with $V_{gmax}$ and $\Delta Q_{2max}$ respectively in formula (14) to become formula (20), from which the value of $V_{gmax}$ can be calculated.

$$V_{gmax} = \frac{\Delta Q_{2max}}{r} V'' \frac{60}{\Delta \tau} \text{ dm}^3/\text{min} \tag{20}$$

Substitute the formula for calculating $\Delta Q_2$max into the above formula, after simplification:

$$V_{gmax} = \frac{120BK_{max}h}{V'} V'' \text{ dm}^3/\text{min} \tag{20'}$$

V' and V" are parameters of the thermophysical properties of liquid nitrogen. They vary with temperature t. When the temperature of liquid nitrogen t is −190° C., the V' and V" are also determined. If B, $K_{max}$ and h are constant, Vmax will also be constant.

6. Formulae for calculating the production parameters for casting an amorphous, ultracrystallite, crystallite and fine grain metal slab with thickness E.

From the above, parameters $V_k$, Δτ, Δm and u are independent of a metal slab's thickness. Their values are still the same as the values in casting an amorphous, ultracrystallite, crystallite and fine grain metallic slab with maximum thickness $E_{max}$. However, parameters ΔV, $\Delta Q_2$, V, $V_g$, which are dependent of quantity of heat, will decrease along with the thickness of a slab with length Δm from $E_{max}$ to E, and the quantity of molten metal and internal heat energy. Their calculations are as follows:

1) Calculate the proportional coefficient X.

$$X = \frac{E_{max}}{E} \tag{21}$$

Where $E_{max}$—maximum thickness of an amorphous, ultracrystallite, crystallite or fine grain metal slab mm;

E—thickness of an amorphous, ultracrystallite, crystallite or fine grain metal slab mm.

X—the proportional coefficient.

2) Calculate $\Delta Q_2$, ΔV, V and Vg

Because the internal heat energy in molten metal with length Δm is directly proportional to the thickness of the metal slab, the following formula is tenable.

$$X = \frac{\Delta Q_{2max}}{\Delta Q_2} = \frac{\Delta V_{max}}{\Delta V} = \frac{V_{max}}{V} = \frac{V_{gmax}}{V_g} \tag{22}$$

3) Calculate the liquid nitrogen's ejection speed K

If the liquid nitrogen layer's thickness h=2 mm is kept constant, the liquid nitrogen's ejection speed will drop from $K_{max}$ to K when the quantity of ejected liquid nitrogen drops from $V_{max}$ to V. The relationship between $K_{max}$ and K conforms to formula (23).

$$X = \frac{K_{max}}{K} \tag{23}$$

The above formula indicates that by using the proportional coefficient formulae (21), (22) and (23), the production parameters for amorphous, ultracrystallite, crystallite and fine grain metal slabs with thickness E can be calculated with parameters relating to $E_{max}$.

According to the above formulae, the production parameters for different metal types and thickness of amorphous, ultracrystallite, crystallite or fine grain metal slabs can be calculated. The calculated results can be used for a production trial and the design and manufacture of the L,R,C method continuous casting system to produce the desired slabs.

In order to illustrate how to determine the production parameters and how to organize production for casting amorphous, ultracrystallite, crystallite and fine grain metal slab through the L,R,C method and its continuous casting system using the calculation formulae, the 0.23C steel slab with width B=1 m and the aluminum slab with width B=1 m are used as ferrous and nonferrous examples respectively to illustrate how to apply the formulae to determine the production parameters and how to organize production.

7. Casting amorphous, ultracrystallite, crystallite and fine grain steel slabs using the L,R,C method and its continuous casting system, and the determination of the production parameters.

The relevant parameters and the thermal parameters of the 0.23C steel slabs are as follows:

B—width of the steel slab, B=1 m

E—thickness of the steel slab, E=Xm

L—the latent heat, L=310 KJ/Kg $\lambda_{CP}$—average thermal conductivity, $\lambda_{CP}=36.5\times10^{-3}$ KJ/m·° C.s[appendix 1]

$\rho_{CP}$—average density, $\tau_{CP}=7.86\times10^{3}$ Kg/m$^3$[appendix 1]

$C_{CP}$—average specific heat, $C_{CP}=0.822$ KJ/Kg° C.[appendix 1]

$t_1$—initial solidification temperature, $t_1=1550°$ C.

$t_2$—ending solidification and cooling temperature, $t_2=-190°$ C.

The thermal parameters of liquid nitrogen are as follows [appendix2]

TABLE 2

The thermal parameters of liquid nitrogen

| t ° C. | p bar | V' dm$^3$/Kg | V'' dm$^3$/Kg | r KJ/Kg |
|---|---|---|---|---|
| −190 | 1.877 | 1.281 | 122.3 | 190.7 |

In the table t—temperature of liquid nitrogen, ° C., t=−190° C.

p—pressure of the liquid nitrogen at t=−190° C., bar, p=1.877 bar

V'—volume of 1 Kg liquid nitrogen at t=−190° C. and p=1.877 bar, dm$^3$/Kg

V''—volume of 1 Kg nitrogen gas at t=−190° C. and p=1.877 bar, dm$^3$/Kg r—the latent heat at t=−190° C. and p=1.877 bar; that is, the quantity of heat which is absorbed when 1 Kg liquid nitrogen is gasified at t=−190° C. and p=1.877 bar, KJ/Kg 1) Using the L,R,C method and its continuous casting system to cast 0.23C amorphous steel slab and the determination of the production parameters 1.1) Using the L,R,C method and its continuous casting system to cast 0.23C amorphous steel slab of maximum thickness $E_{max}$, and the determination of the production parameters (1) Determine the cooling rate $V_k$ in the whole solidification and cooling process of the 0.23C amorphous slab Let $V_K=10^{7}$° C./s (2) Calculate Δτ

Substitute the data of $V_K$, $t_1$, $t_2$ into the formula (1) to get $$\Delta\tau = \frac{t_1 - t_2}{V_K} = \frac{1550-(-190)}{10^7} = 1.74\times10^{-4}\ \text{s}$$

(3) Calculate Δm

For amorphous steel slabs, Δm is calculated with formula (8)

$$\Delta m = \sqrt{\frac{\lambda_{CP}}{\rho_{CP}C_{CP}}\Delta\tau} = \sqrt{\frac{36.5\times10^{-3}}{7.86\times10^{3}\times0.822}\times1.74\times10^{-4}} = 0.03135\ \text{mm}$$

(4) Calculate u u is calculated with formula (10)

$$u = \frac{\Delta m}{\Delta\tau} = \frac{0.03135}{1.74\times10^{-4}} = 10.81\ \text{m/min}$$

(5) Calculate $\Delta V_{max}$, $\Delta V_{max}$ is calculated with formula (15)

Let $K_{max}=30$ m/s $$\Delta V_{max}=2BK_{max}\Delta\tau h=2\times1\times10^{3}\times30\times10^{3}\times1.74\times10^{-4}\times2=0.02088\ \text{dm}^3$$

(6) Calculate $\Delta Q_{2max}$ $\Delta Q_{2max}$ is calculated with formula (16)

$$\Delta Q_{2max} = \frac{\Delta V_{max} r}{V'} = \frac{0.02088\times190.7}{1.281} = 3.1084\ KJ$$

(7) Calculate $E_{max}$ $E_{max}$ is calculated with formula (17)

$$E_{max} = \frac{\Delta Q_{2max}}{B\Delta m\rho_{CP}C_{CP}\Delta t} = \frac{3.1084}{100\times0.003135\times7.8\times10^{-3}\times0.822\times1740} = 8.9\ \text{mm}$$

(8) Calculate $V_{max}$ $V_{max}$ is calculated with formula (19), $$V_{max}=120BK_{max}h=120\times1\times10^{3}\times30\times10^{3}\times2=7200\ \text{dm}^3/\text{min}$$

(9) Calculate $V_{gmax}$ $V_{gmax}$ is calculated with formula (20), $$V_{gmax} = \frac{120BK_{max}h}{V'}V'' = \frac{120\times1\times10^{3}\times30\times10^{3}\times2}{1.281}\times122.3 = 687400.5\ \text{dm}^3/\text{min}$$

The above calculation indicates that when liquid nitrogen in liquid nitrogen ejector (5) is ejected to the 0.23C steel slab at the outlet of the hot casting mould (4) with an ejection layer of thickness h=2 mm, a maximum ejection speed of $K_{max}$=30 m/S and a maximum ejection quantity of $V_{max}$=7200 $dm^3$/min, the guidance traction device (6) draws the slabs to leave the outlet of the hot casing mould (4) with a continuous casting speed u=10.81 m/min. The L,R,C method and its continuous casting system can make molten metal with temperature $t_1$=1550° C., cross section 1000×8.9 $mm^2$ and length Δm=0.03135 mm solidified and cooled to $t_2$=−190° C. at a cooling rate $V_K$=$10^7$° C./S and finally continuously casting a 0.23C amorphous steel slab with maximum thickness $E_{max}$=8.9 mm and width B=1000 mm.

1.2) Using the L,R,C method and its continuous casting system to cast a 0.23C amorphous steel slab of thickness E and the determination of the production parameters (1) Let E=5 mm. The values of parameters $V_k$, Δτ, Δm, u corresponding to E=5 mm are the same as those corresponding to $E_{max}$=8.9 mm. That is, $V_k$=$10^7$° C./S, Δτ=1.74×$10^{-4}$ s, Δm=0.03135 mm, u=10.81 m/min.

(2) Calculate X

X is calculated with formula (21).

$$X = \frac{E_{max}}{E} = \frac{8.9}{5} = 1.78$$

(3) Calculate ΔV

ΔV is calculated with formula (22)

$$\Delta V = \frac{V_{max}}{V} = \frac{0.02088}{1.78} = 0.01173\ dm^3$$

(4) Calculate $\Delta Q_2$ $\Delta Q_2$ is calculated with formula (22)

$$\Delta Q_2 = \frac{\Delta Q_{2max}}{X} = \frac{3.1084}{1.78} = 1.746\ KJ$$

(5) Calculate V

V is calculated with formula (22)

$$V = \frac{V_{max}}{X} = \frac{7200}{1.78} = 4044.9\ dm^3/min$$

(6) Calculate $V_g$ $V_g$ is calculated with formula (22)

$$V_g = \frac{V_{gmax}}{X} = \frac{687400.5}{1.78} = 386180.1\ dm^3/min$$

(7) Calculate K

K is calculated with formula (23)

$$K = \frac{K_{max}}{X} = \frac{30}{1.78} = 16.9\ m/s$$

The above calculation indicates that when the continuous casting speed u is fixed at 10.81 m/min and the thickness of ejected liquid nitrogen layer is fixed at 2 mm, the ejected quantity of liquid nitrogen falls to V=4044.9 $dm^3$/min, and the corresponding liquid nitrogen's ejection speed drops to K=16.9 m/s. This will cast E=5 mm thick 0.23C amorphous steel slabs continuously.

2) Using the L,R,C method and its continuous casting system to cast 0.23C ultracrystallite steel slab and the determination of the production parameters In the study on continuous casting of 0.23C ultracrystallite steel slab, the production parameters for producing slabs with maximum thickness $E_{max}$ or other thickness E is explored at different cooling rates $V_k$. The combination of cooling rates $V_k$ used are 2×$10^{6}$° C./s, 4×$10^{6}$° C./s, 6×$10^{6}$° C./s, or 8×$10^{6}$° C./s respectively.

2.1) Determining the maximum thickness $E_{max}$ when using the L,R,C method and its continuous casting system to cast 0.23C ultracrystallite steel slabs at cooling rates $V_k$=2×$10^{6}$° C./s, and the determination of the production parameters Let $K_{max}$=30 m/s and h=2 mm remain constant, and $V_K$=2×$10^{6}$° C./s.

(1) Calculate Δτ

Δτ is calculated with formula (1).

$$\Delta\tau = \frac{t_1 - t_2}{V_K} = \frac{1550 - (-190)}{2 \times 10^6} = 8.7 \times 10^{-4}\ s$$

(2) Calculate Δm

For ultracrystallite steel slabs, latent heat exists in the solidification process, and Δm is calculated with formula (9).

$$\Delta m = \sqrt{\frac{\lambda_{CP}}{\rho_{CP}(C_{CP}\Delta t + L)V_K} \cdot \Delta t} = \sqrt{\frac{36.5 \times 10^{-3}}{7.86 \times 10^3 (0.822 \times 1740 + 310) \times 2 \times 10^6} \times 1740} = 0.0636\ mm$$

(3) Calculate u u is calculated with formula (10)

$$u = \frac{\Delta m}{\Delta \tau} = \frac{0.0636}{8.7\times10^{-4}} = 4.39\ \text{m/min}$$

(4) Calculate $\Delta V_{max}$ $\Delta V_{max}$ is calculated with formula (15).

$$\Delta V_{max}=2BK_{max}\Delta\tau h=2\times1\times10^3\times30\times10^3\times8.7\times10^{-4}\times2=0.1044\ \text{dm}^3$$

(5) Calculate $\Delta Q_{2max}$ $\Delta Q_{2max}$ is calculated with formula (16)

$$\Delta Q_{2max} = \frac{\Delta V_{max} r}{V'} = \frac{0.1044\times190.7}{1.281} = 15.55\ KJ$$

(6) Calculate $E_{max}$

For ultracrystallite steel slabs, $E_{max}$ is calculated with formula (18)

$$E_{max} = \frac{\Delta Q_{2max}}{B\Delta m\rho_{CP}(C_{CP}\Delta t + L)} = \frac{15.55}{100\times0.00636\times7.8\times10^{-3}(0.822\times1740+310)} = 18\ \text{mm}$$

(7) Calculate $V_{max}$ $V_{max}$ is calculated with formula (19)'

$$V_{max}=120BK_{max}h=120\times1\times10^3\times30\times10^3\times2=7200\ \text{dm}^3/\text{min}$$

(8) Calculate $V_{gmax}$ $V_{gmax}$ is calculated with formula (20)'

$$V_{gmax} = \frac{120\ BK_{max}h}{V'}V'' = \frac{120\times1\times10^3\times30\times10^3\times2}{1.281}\times122.3 = 687400.5\ \text{dm}^3/\text{min}$$

2.2) Using the L,R,C method and its continuous casting system to cast 0.23C ultracrystallite steel slabs with cooling rate $V_k=2\times10^{6\circ}$ C./s and thickness E, and the determination of the production parameters (1) Let E=15 mm. The values of parameters $V_k$, $\Delta\tau$, $\Delta m$, u corresponding to E=15 mm are the same as those corresponding to $E_{max}$=18 mm. That is, $V_k=2\times10^{6\circ}$ C./s, $\Delta\tau=8.7\times10^{-4}$ S. $\Delta m$=0.0636 mm, u=4.39 m/min.

(2) Calculate X

X is calculated with formula (21)

$$X = \frac{E_{max}}{E} = \frac{18}{15} = 1.2$$

(3) Calculate $\Delta V$ $\Delta V$ is calculated with formula (22)

$$\Delta V = \frac{V_{max}}{X} = \frac{0.1044}{1.2} = 0.087\ \text{dm}^3$$

(4) Calculate $\Delta Q_2$ $\Delta Q_2$ is calculated with formula (22)

$$\Delta Q_2 = \frac{\Delta Q_{2max}}{X} = \frac{15.55}{1.2} = 12.96\ KJ$$

(5) Calculate V

V is calculated with formula (22)

$$V = \frac{V_{max}}{X} = \frac{7200}{1.2} = 6000\ \text{dm}^3/\text{min}$$

(6) Calculate $V_g$ $V_g$ is calculated with formula (22)

$$V_g = \frac{V_{gmax}}{X} = \frac{687400.5}{1.2} = 572833.8\ \text{dm}^3/\text{min}$$

(7) Calculate K

K is calculated with formula (23)

$$K = \frac{K_{max}}{X} = \frac{30}{1.2} = 25\ \text{m/s}$$

The formulae (programs) used for calculating the production parameters at other cooling rates combinations $V_k$ to produce 0.23C ultracrystallite steel slabs with maximum thickness $E_{max}$ or other thickness E are the same as those for cooling rate $V_k=2\times10^{6\circ}$ C./s. The calculation results are listed in table 3, table 4, table 5, table 6, table 7 and table 8. The calculation process will not be repeated herein.

3) Using the L,R,C method and its continuous casting system to cast 0.23C crystallite steel slabs at maximum thickness $E_{max}$ or other thickness E and the determination of the production parameters The range of cooling rates $V_k$ for crystallite structures is $V_k\geq10^{4\circ}$ C./s~$10^{6\circ}$ C./s. Steel slabs which are continuously cast at cooling rate $V_k=10^{6\circ}$ C./s in solidification and cooling are called Crystallite Steel Slab A. Steel slab which are continuously cast at cooling rate $V_k=10^{5\circ}$ C./s in solidification and cooling are called Crystallite Steel Slab B. The L,R,C method and its continuous machine system's production parameters used to continuously cast Crystallite Steel Slab A and Crystallite Steel Slab B with maximum thickness $E_{max}$ or other thickness E are calculated. The application of the calculation programs and formula is the same as those for ultracrystallite steel slabs. The relevant production parameters are listed in table 3, table 4, table 5, table 6, table 7 and table 8. The calculating process will not be repeated herein.

4) Using the L,R,C method and its continuous casting system to cast 0.23C fine grain steel slabs at maximum thickness $E_{max}$ or other thickness E and the determination of the production parameters The range of cooling rates $V_k$ for fine grain structure is $V_k\leq10^{4\circ}$ C./s. The relevant production parameters are listed in table 3, table 4, table 5, table 6, table 7 and table 8. The calculating process will not be repeated herein.

TABLE 3

Maximum thickness $E_{max}$ and the production parameters of 0.23 C amorphous, ultracrystallite, crystallite and fine grain steel slabs (B = 1 m, $K_{max}$ = 30 m/s, h = 2 mm)

| | | Metal structure | | | | | | | |
|---|---|---|---|---|---|---|---|---|---|
| | | Amorphous | Ultracrystallite | | | | Crystallite A | Crystallite B | Fine Grain |
| Vk | ° C./s | $10^7$ | $8\times10^6$ | $6\times10^6$ | $4\times10^6$ | $2\times10^6$ | $10^6$ | $10^5$ | $10^4$ |
| Δτ | s | $1.74\times10^{-4}$ | $2.175\times10^{-4}$ | $2.9\times10^{-4}$ | $4.35\times10^{-4}$ | $8.7\times10^{-4}$ | $1.74\times10^{-3}$ | $1.74\times10^{-2}$ | $1.74\times10^{-1}$ |
| Δm | mm | 0.03135 | 0.0318 | 0.0367 | 0.0449 | 0.0636 | 0.0899 | 0.284 | 0.899 |
| u | m/min | 10.81 | 8.77 | 7.59 | 6.20 | 4.39 | 3.1 | 0.98 | 0.31 |
| ΔVmax | $dm^3$ | 0.02088 | 0.0261 | 0.0348 | 0.0522 | 0.1044 | 0.209 | 2.09 | 20.9 |
| $\Delta Q_{2max}$ | KJ | 3.1084 | 3.89 | 5.18 | 7.771 | 15.54 | 31.113 | 311.13 | 3111.3 |
| $E_{max}$ | mm | 8.9 | 9 | 10.4 | 12.8 | 18 | 25.5 | 80.6 | 255 |
| $V_{max}$ | $dm^3$/min | 7200 | 7200 | 7200 | 7200 | 7200 | 7200 | 7200 | 7200 |
| $V_{gmax}$ | $dm^3$/min | 687400.5 | 687400.5 | 687400.5 | 687400.5 | 687400.5 | 687400.5 | 687400.5 | 687400.5 |

TABLE 4

E =20 mm, the production parameters of 0.23 C amorphous, ultracrystallite, crystallite and fine grain steel slabs (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8\times10^6$ | $6\times10^6$ | $4\times10^6$ | $2\times10^6$ | $10^6$ | $10^5$ | $10^4$ |
| u | m/min | 10.81 | 8.77 | 7.59 | 6.20 | 4.39 | 3.1 | 0.98 | 0.31 |
| X | | | | | | | 1.275 | 4.03 | 12.75 |
| V | $dm^3$/min | | | | | | 5647.1 | 1786.6 | 564.7 |
| K | m/s | | | | | | 23.53 | 7.4 | 2.35 |

TABLE 5

E = 15 mm, the production parameters of 0.23 C amorphous, ultracrystallite, crystallite and fine grain steel slabs (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8\times10^6$ | $6\times10^6$ | $4\times10^6$ | $2\times10^6$ | $10^6$ | $10^5$ | $10^4$ |
| u | m/min | 10.81 | 8.77 | 7.59 | 6.20 | 4.39 | 3.1 | 0.98 | 0.31 |
| X | | | | | | 1.2 | 1.7 | 5.37 | 17 |
| V | $dm^3$/min | | | | | 6000 | 4235.3 | 1340 | 423.5 |
| K | m/s | | | | | 25 | 17.6 | 5.6 | 1.76 |

TABLE 6

E = 10 mm, the production parameters of 0.23 C amorphous, ultracrystallite, crystallite and fine grain steel slabs (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine grain |
| $V_k$ | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 10.81 | 8.77 | 7.59 | 6.20 | 4.39 | 3.1 | 0.98 | 0.31 |
| X | | | | 1.04 | 1.28 | 1.8 | 2.55 | 8.06 | 25.5 |
| V | $dm^3$/min | | | 6923.1 | 5625 | 4000 | 2823.4 | 893.3 | 282.4 |
| K | m/s | | | 28.9 | 23.4 | 16.7 | 11.8 | 3.72 | 1.18 |

TABLE 7

E = 5 mm, the production parameters of 0.23 C amorphous, ultracrystallite, crystallite and fine grain steel slabs (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine grain |
| $V_k$ | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 10.81 | 8.77 | 7.59 | 6.20 | 4.39 | 3.1 | 0.98 | 0.31 |
| X | | 1.78 | 1.8 | 2.08 | 2.56 | 3.6 | 5.1 | 16.12 | 51 |
| V | $dm^3$/min | 4044.9 | 4000 | 3461.5 | 2812.5 | 2000 | 1411.7 | 446.7 | 141.18 |
| K | m/s | 16.9 | 16.7 | 14.4 | 11.7 | 8.3 | 5.9 | 1.86 | 0.59 |

TABLE 8

E = 1 mm, the production parameters of 0.23 C amorphous, ultracrystallite, crystallite and fine grain steel slabs (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine crystal |
| Vk | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 10.81 | 8.77 | 7.59 | 6.20 | 4.39 | 3.1 | 0.98 | 0.31 |
| X | | 8.9 | 9 | 10.4 | 12.8 | 18 | 25.5 | 80.6 | 255 |
| V | $dm^3$/min | 809 | 800 | 692.3 | 562.5 | 400 | 282.4 | 89.3 | 28.2 |
| K | m/s | 3.37 | 3.3 | 2.9 | 2.3 | 1.7 | 1.18 | 0.37 | 0.12 |

Table 3 provides maximum thickness $E_{max}$ and its corresponding production parameters for continuously casting 0.23C amorphous, ultracrystallite, crystallite and fine grain steel slabs. Table 4-8 provides the corresponding production parameters of 0.23C amorphous, ultracrystallite, crystallite or fine grain steel slabs when thickness E=20 mm, 15 mm, 10 mm, 5 mm and 1 mm. In the above mentioned thickness range, corresponding production parameters can be determined by referring to the tables.

As for Crystallite Steel Slab B, because Δm=0.284 mm, if the thickness of the steel slab is less than 2.84 mm, Δm>E/10, it does not meet the condition for one-dimensional stable-state heat conduction. Similarly for fine grain steel slabs with Δm=0.899 mm, if the thickness of the steel slab is less than 9 mm, it does not meet the condition for one-dimensional stable-state heat conduction as well. That is, the data of Crystallite B shown in table 8 and the data of fine grain shown in table 7 and 8 cannot be used.

In order to meet the requirements of the production parameters in table 3-8, the ejection system of the continuous casting machine of the L,R,C method should have the following features:

For 0.23C amorphous steel slabs with E=1 mm-8.9 mm, the quantity of ejected liquid nitrogen should be adjustable within the range of 809 $dm^3$/min~7200 $dm^3$/min, and the liquid nitrogen's ejection speed should be adjustable within the range of 3.37 m/s~30 m/s.

For 0.23C ultracrystallite steel slabs with E=1 mm-18 mm, the quantity of ejected liquid nitrogen should be adjustable within the range of 400 $dm^3$/min~7200 $dm^3$/min, and the liquid nitrogen's ejection speed should be adjustable within the range of 1.7 m/s~30 m/s.

For 0.23C Crystallite Steel Slab A with E=1 mm-25.5 mm, the quantity of ejected liquid nitrogen should be adjustable within the range of 282.4 $dm^3$/min~7200 $dm^3$/min, and the liquid nitrogen's ejection speed should be adjustable within the range of 1.18 m/s-30 m/s.

For 0.23C Crystallite Steel Slab B with E=1 mm-80.6 mm, the quantity of ejected liquid nitrogen should be adjustable within the range of 89.3 $dm^3$/min~7200 $dm^3$/min, and the liquid nitrogen's ejection speed should be adjustable within the range of 0.37 m/s~30 m/s.

For 0.23C fine grain steel slabs with E=1 mm-255 mm, the quantity of ejected liquid nitrogen should be adjustable within the range of 28.2 $dm^3$/min~7200 $dm^3$/min, and the liquid nitrogen's ejection speed should be adjustable within the range of 0.12 m/s~30 m/s.

8. Casting amorphous, ultracrystallite, crystallite and fine grain aluminum slabs using the L,R,C method and its continuous casting system, and the determination of production parameters The relevant parameters and the thermal parameters of aluminum slabs are as follows:

B—width of aluminum slab, B=1 m

E—thickness of aluminum slab, E=X m

L—the latent heat, L=397.67 KJ/K g $\lambda_{CP}$—average thermal conductivity, $\lambda_{CP}=256.8\times10^{-3}$ KJ/m·° C.s[appendix 1]

$\rho_{CP}$—average density, $\rho_{CP}=2.591\times10^{3}$ Kg/m$^3$ [appendix 1]

$C_{CP}$—average specific heat, $C_{CP}=1.085$ KJ/Kg° C.[appendix 1]

$t_1$—initial solidification temperature, $t_1=750°$ C.

$t_2$—ending solidification and cooling temperature, $t_2=-190°$ C.

The condition of the cold source is the same as that used in continuous casting 0.23C steel slabs. The thermal parameters of the liquid nitrogen are shown in table 2.

1) Using the L,R,C method and its continuous casting system to cast amorphous aluminum slabs and the determination of the production parameters 1.1) Using the L,R,C method and its continuous casting system to cast amorphous aluminum slabs of maximum thickness $E_{max}$ and the determination of the production parameters (1) Determine cooling rate $V_K$ in the whole solidification and cooling process of aluminum slabs Let $V_K=10^7$° C./s (2) Calculate Δτ

Δτ is calculated with formula (1)

$$\Delta\tau = \frac{t_1 - t_2}{V_K} = \frac{750-(-190)}{10^7} = 9.4\times10^{-5}\ \text{s}$$

(3) Calculate Δm

Δm is calculated with formula (8).

$$\Delta m = \sqrt{\frac{\lambda_{CP}}{\rho_{CP}C_{CP}}\Delta\tau} = \sqrt{\frac{256.8\times10^{-3}}{2.591\times10^{3}\times1.085}\times9.4\times10^{-5}} = 0.093\ \text{mm}$$

(4) Calculate u u is calculated with formula (10).

$$u = \frac{\Delta m}{\Delta\tau} = \frac{0.093}{9.4\times10^{-5}} = 59.15\ \text{m/min}$$

(5) Calculate $\Delta V_{in}$.

$\Delta V_{max}$ is calculated with formula (15)

Let Kmax=30 m/s $$\Delta V_{max}=2BK_{max}\Delta\tau h=2\times1\times10^{3}\times30\times10^{3}\times9.4\times10^{-5}\times2=0.01128\ \text{dm}^3$$

(6) Calculate $\Delta Q_{2max}$ $\Delta Q_{2max}$ is calculated with formula (16)

$$\Delta Q_{2max} = \frac{\Delta V_{max}r}{V'} = \frac{0.01128\times190.7}{1.281} = 1.679\ KJ$$

(7) Calculate $E_{max}$ $E_{max}$ is calculated with formula (17)

$$E_{max} = \frac{\Delta Q_{2max}}{B\Delta m\rho_{CP}C_{CP}\Delta t} = \frac{1.679}{100\times0.0093\times2.591\times10^{-3}\times1.085\times940} = 6.8\ \text{mm}$$

(8) Calculate $V_{max}$ $V_{max}$ is calculated with formula (19)'

$$V_{max}=120BK_{max}h=120\times1\times10^{3}\times30\times10^{3}\times2=7200\ \text{dm}^3/\text{min}$$

(9) Calculate $V_{gmax}$ $V_{gmax}$ is calculated with formula (20)'

$$V_{gmax} = \frac{120\ BK_{max}h}{V'}V'' = \frac{120\times1\times10^{3}\times30\times10^{3}\times2}{1.281}\times122.3 = 687400.5\ \text{dm}^3/\text{min}$$

1.2) Using the L,R,C method and its continuous casting system to cast amorphous aluminum slabs of thickness E and the determination of the production parameters (1) Let E=5 mm. The values of $V_k$, Δτ, Δm, u corresponding to E=5 mm are still the same as those corresponding to $E_{max}$=6.8 mm. That is, $V_k=10^7$° C./s, $\Delta\tau=9.4\times10^{-5}$ s, Δm=0.093 mm, u=59.15 m/min.

(2) Calculate X

X is calculated with formula (21)

$$X = \frac{E_{max}}{E} = \frac{6.8}{5} = 1.36$$

(3) Calculate ΔV

ΔV is calculated with formula (22)

$$\Delta V = \frac{\Delta V_{max}}{X} = \frac{0.0128}{1.36} = 0.00583\ \text{dm}^3$$

(4) Calculate $\Delta Q_2$ $\Delta Q_2$ is calculated with formula (22)

$$\Delta Q_2 = \frac{\Delta Q_{2max}}{X} = \frac{1.679}{1.36} = 1.24\ KJ$$

(5) Calculate V

V is calculated with formula (22)

$$V = \frac{V_{max}}{X} = \frac{7200}{1.36} = 5294.1\ \mathrm{dm^3/min}$$

(6) Calculate $V_g$ $V_g$ is calculated with formula (22)

$$V_g = \frac{V_{gmax}}{X} = \frac{687400.5}{1.36} = 505441.5\ \mathrm{dm^3/min}$$

(7) Calculate K

K is calculated with formula (23)

$$K = \frac{K_{max}}{X} = \frac{30}{1.36} = 22.1\ \mathrm{m/s}$$

Comparing the production parameters of the L,R,C method used for continuous casting of 0.23C amorphous steel slab with those used for continuous casting of aluminum slabs, we can find that when the production parameters of liquid nitrogen are the same ($V_{max}$=7200 $dm^3$/min, $K_{max}$=30 m/s, h=2 mm), the maximum thickness of 0.23C amorphous steel slabs is $E_{max}$=8.9 mm while the maximum thickness of amorphous aluminum slabs is $E_{max}$=6.8 mm. The $E_{max}$ of steel slabs is 1.31 times thicker than the $E_{max}$ of aluminum slabs. The casting speed of amorphous steel slabs is u=10.81 m/min while the casting speed of amorphous aluminum slabs is u=59.15 m/min; that is, in one minute, 10.81 m of 0.23C amorphous steel slabs with thickness 8.9 mm can be cast while 59.15 m of amorphous aluminum slabs with thickness 6.8 mm can be cast. The main reason is that the Δm values of these two kinds of slabs are different. The Δm value of amorphous metal structure is determined by formula (8).

$$\Delta m = \sqrt{\alpha_{CP}\Delta\tau} \tag{8}$$

Where $\alpha_{CP}$—average thermal diffusivity coefficient of the metal $$\alpha_{CP} = \frac{\lambda_{CP}}{\rho_{CP}C_{CP}}\ \mathrm{m^2/s}$$

When using the L,R,C method to continuously cast metal slabs, if $\lambda_{CP}$ of a certain metal is larger and $\rho_{CP}C_{CP}$ is smaller, the quantity of heat transmitted by that metal is larger and the quantity of heat stored is smaller, thus causing the value of that metal's Δm to be larger. The quantity of heat transmitted through cross section a-c shown in FIG. 2 is $\Delta Q_1$ and $$\Delta Q_1 = \lambda_{CP} A \frac{\Delta t}{\Delta m}\Delta\tau$$

When $\lambda_{CP}$ increases, the value of $\Delta Q_1$ increases. In order to maintain $\Delta Q_1 = \Delta Q_2$, the value of $\Delta Q_2$ must increase. $\Delta Q_2$ is the internal heat in molten metal with length Δm.

$$\Delta Q_2 = BE\Delta m \rho_{CP} C_{CP} \Delta t$$

$\rho_{CP}C_{CP}$ of aluminum is smaller. So if the value of $\Delta Q_2$ is to increase, the value of Δm must increase. The increase in Δm's value makes $\Delta Q_2$ increase but $\Delta Q_1$ decrease. When Δm increases to a certain value where $\Delta Q_1 = \Delta Q_2$, then the value of Δm is determined.

According to the calculations, for 0.23C steel $\alpha_{CP}$=0.0203 $m^2$/h and $\Delta\tau = 1.74\times10^{-4}$ s, for aluminum $\alpha_{CP}$=0.329 $m^2$/h and $\Delta\tau = 9.4\times10^{-5}$ s. The combined action of $\alpha_{CP}$ and Δτ makes Δm=0.093 mm for amorphous aluminum and Δm=0.03135 mm for 0.23C steel. There is a 3 times difference between the two Δm's. The larger Δm value of aluminum causes the continuous casting speed to increase to u=59.15 m/min. It not only requires the traction speed of the guidance traction device (6) shown in FIG. 1 to reach 59.15 m/min, but also requires steady movement, without any fluctuation, resulting in a certain degree of difficulty in the mechanism's setup.

2) Using the L,R,C method and its continuous casting system to cast ultracrystallite aluminum slabs and the determination of the production parameters The combination of cooling rates $V_k$ used for ultracrystallite aluminum slabs are: $2\times10^{6\circ}$ C./s, $4\times10^{6\circ}$ C./s, $6\times10^{6\circ}$ C./s and $8\times10^{6\circ}$ C./s respectively.

2.1) Determining maximum thickness $E_{max}$ when using the L,R,C method and its continuous casting system to cast ultracrystallite aluminum slabs at cooling rate $V_K = 2\times10^{6\circ}$ C./s, and the determination of the production parameters Let Kmax=30 m/s and h=2 mm remain constant.

(1) Calculate Δτ

Δτ is calculated with formula (1)

$$\Delta\tau = \frac{t_1 - t_2}{V_K} = \frac{750-(-190)}{2\times10^6} = 4.7\times10^{-4}\ \mathrm{s}$$

(2) Calculate Δm

For ultracrystallite aluminum slabs, the latent heat is released in the solidification process. Δm is calculated with formula (9)

$$\Delta m = \sqrt{\frac{\lambda_{CP}}{\rho_{CP}(C_{CP}\Delta t + L)V_K} \cdot \Delta t}$$

$$= \sqrt{\frac{256.8 \times 10^{-3}}{2.591 \times 10^3 (1.085 \times 940 + 397.67) \times 2 \times 10^6}} \times 940$$

$$= 0.176 \text{ mm}$$

(3) Calculate u u is calculated with formula (10)

$$u = \frac{\Delta m}{\Delta \tau}$$

$$= \frac{0.176}{4.7 \times 10^{-4}}$$

$$= 22.5 \text{ m/min}$$

(4) Calculate $\Delta V_{max}$ $\Delta V_{max}$ is calculated with formula (15)

$$\Delta V_{max} = 2BK_{max}\Delta\tau h = 2 \times 1 \times 10^3 \times 30 \times 10^3 \times 4.7 \times 10^{-4} \times 2 = 0.0564 \text{ dm}^3$$

(5) Calculate $\Delta Q_{2max}$ $\Delta Q_{2max}$ is calculated with formula (16)

$$\Delta Q_{2max} = \frac{\Delta V_{max} r}{V'}$$

$$= \frac{0.0564 \times 190.7}{1.281}$$

$$= 8.4 \ KJ$$

(6) Calculate $E_{max}$

For the ultracrystallite aluminum slab, $E_{max}$ is calculated with formula (18)

$$E_{max} = \frac{\Delta Q_{2max}}{B\Delta m \rho_{CP}(C_{CP}\Delta t + L)}$$

$$= \frac{8.4}{100 \times 0.0176 \times 2.591 \times 10^{-3} \times (1.085 \times 940 + 397.6)}$$

$$= 13 \text{ mm}$$

(7) Calculate $V_{max}$ $V_{max}$ is calculated with formula (19)'

$$V_{max} = 120BK_{max}h = 120 \times 1 \times 10^3 \times 30 \times 10^3 \times 2 = 7200 \text{ dm}^3/\text{min}$$

(8) Calculate $V_{gmax}$ $V_{gmax}$ is calculated with formula (20)'

$$V_{gmax} = \frac{120BK_{max}h}{V'} V''$$

$$= \frac{120 \times 1 \times 10^3 \times 30 \times 10^3 \times 2}{1.281} \times 122.3$$

$$= 687400.5 \text{ dm}^3/\text{min}$$

The production parameters in using cooling rate $V_K = 2 \times 10^{6\circ}$ C. Is to produce ultracrystallite aluminum slabs with other thickness E are calculated. The production parameters in using cooling rate $V_K = 4 \times 10^{6\circ}$ C. Is, $6 \times 10^{6\circ}$ C./s, or $8 \times 10^{6\circ}$ C./s to produce ultracrystallite aluminum slab with maximum thickness or other thickness E are calculated. The production parameters in using cooling rate $V_K = 10^{6\circ}$ C./S, $10^{5\circ}$ C./S or $10^{4\circ}$ C./s to produce Crystallite A, Crystallite B or fine grain aluminum slabs with maximum thickness or other thickness E are calculated. All the above calculation results are listed in table 9, table 10, table 11, table 12, table 13 and table 14. The description for the calculation process will not be repeated herein.

TABLE 9

The maximum thickness $E_{max}$ and production parameters of amorphous, ultracrystallite, crystallite and fine grain aluminum slabs (B = 1 m, $K_{max}$ = 30 m/s, h = 2 mm)

| | | Metal Structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8 \times 10^6$ | $6 \times 10^6$ | $4 \times 10^6$ | $2 \times 10^6$ | $10^6$ | $10^5$ | $10^4$ |
| Δτ | S | $9.4 \times 10^{-5}$ | $1.18 \times 10^{-4}$ | $1.57 \times 10^{-4}$ | $2.35 \times 10^{-4}$ | $4.7 \times 10^{-4}$ | $9.4 \times 10^{-4}$ | $9.4 \times 10^{-3}$ | $9.4 \times 10^{-2}$ |
| Δm | mm | 0.093 | 0.088 | 0.102 | 0.124 | 0.176 | 0.249 | 0.786 | 2.49 |
| u | m/min | 59.15 | 44.8 | 38.8 | 31.7 | 22.5 | 15.87 | 5.02 | 1.59 |
| ΔVmax | $dm^3$ | 0.01128 | 0.0142 | 0.0188 | 0.0282 | 0.0564 | 0.1128 | 1.128 | 11.28 |
| $\Delta Q_{2max}$ | KJ | 1.679 | 2.11 | 2.8 | 4.2 | 8.4 | 16.792 | 167.92 | 1679.2 |
| $E_{max}$ | mm | 6.8 | 6.5 | 7.5 | 9.2 | 13 | 18.4 | 52.8 | 188.6 |
| $V_{max}$ | $dm^3$/min | 7200 | 7200 | 7200 | 7200 | 7200 | 7200 | 7200 | 7200 |
| $V_{gmax}$ | $dm^3$/min | 687400.5 | 687400.5 | 687400.5 | 687400.5 | 687400.5 | 687400.5 | 687400.5 | 687400.5 |

TABLE 10

E = 20 mm, the production parameters of amorphous, ultracrystallite, crystallite and fine grain aluminum slabs (B = 1 m, h = 2 mm)

| | | Metal Structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 59.15 | 44.8 | 38.8 | 31.7 | 22.5 | 15.87 | 5.02 | 1.59 |
| X | | | | | | | | 2.91 | 9.18 |

TABLE 10-continued

E = 20 mm, the production parameters of amorphous, ultracrystallite, crystallite and fine grain aluminum slabs (B = 1 m, h = 2 mm)

| | | Metal Structure | | | | |
|---|---|---|---|---|---|---|
| | | Amorphous | Ultracrystallite | Crystallite A | Crystallite B | Fine grain |
| V | $dm^3$/min | | | | 2474.2 | 784.3 |
| K | m/s | | | | 10.31 | 3.27 |

TABLE 11

E = 15 mm, the production parameters of amorphous, ultracrystallite, crystallite and fine grain aluminum slabs (B = 1 m, h = 2 mm)

| | | Metal Structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 59.15 | 44.8 | 38.8 | 31.7 | 22.5 | 15.87 | 5.02 | 1.59 |
| X | | | | | | | 1.23 | 3.88 | 12.2 |
| V | $dm^3$/min | | | | | | 5853.7 | 1855.7 | 590.2 |
| K | m/s | | | | | | 24.4 | 7.73 | 2.5 |

TABLE 12

E = 10 mm, the production parameters of amorphous, ultracrystallite, crystallite and fine grain aluminum slab (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 59.15 | 44.8 | 38.8 | 31.7 | 22.5 | 15.87 | 5.02 | 1.59 |
| X | | | | | | 1.3 | 1.84 | 5.82 | 18.4 |
| V | $dm^3$/min | | | | | 5538.5 | 3913 | 1237.1 | 391.3 |
| K | m/s | | | | | 23.1 | 16.3 | 5.16 | 1.63 |

TABLE 13

E = 5 mm, the production parameters of amorphous, ultracrystallite, crystallite and fine grain aluminum slab (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 59.15 | 44.8 | 38.8 | 31.7 | 22.5 | 15.87 | 5.02 | 1.59 |
| X | | 1.36 | 1.3 | 1.5 | 1.84 | 2.6 | 3.68 | 11.64 | 36.72 |
| V | $dm^3$/min | 5294.1 | 5538.5 | 4800 | 3913 | 2769.2 | 1956.5 | 618.6 | 196.1 |
| K | m/s | 22.1 | 23.1 | 20 | 16.3 | 11.5 | 8.2 | 2.6 | 0.82 |

TABLE 14

E = 1 mm, the production parameters of amorphous, ultracrystallite, crystallite and fine grain aluminum slabs (B = 1 m, h = 2 mm)

| | | Metal structure | | | | | | | |
|---|---|---|---|---|---|---|---|---|---|
| | | Amorphous | Ultracrystallite | | | | Crystallite A | Crystallite B | Fine grain |
| Vk | ° C./s | $10^7$ | $8 \times 10^6$ | $6 \times 10^6$ | $4 \times 10^6$ | $2 \times 10^6$ | $10^6$ | $10^5$ | $10^4$ |
| u | m/min | 59.15 | 44.8 | 38.8 | 31.7 | 22.5 | 15.87 | 5.02 | 1.59 |
| X | | 6.8 | 6.5 | 7.5 | 9.2 | 13 | 18.4 | 58.2 | 183.6 |
| V | $dm^3$/min | 1058.5 | 1107.7 | 960 | 782.6 | 553.8 | 391.3 | 123.7 | 39.2 |
| K | m/s | 4.4 | 4.6 | 4 | 3.26 | 2.31 | 1.63 | 0.52 | 0.16 |

Table 9 provides the maximum thickness $E_{max}$ and its corresponding production parameters for continuously casting amorphous, ultracrystallite, crystallite and fine grain aluminium slabs. Table 10-14 provides the corresponding production parameters for continuously cast amorphous, ultracrystallite, crystallite and fine grain aluminium slabs when thickness E=20 mm, 15 mm, 10 mm, 5 mm and 1 mm respectively. If the thickness is in the above ranges, the corresponding parameters can be determined by referring to these tables.

As for ultracrystallite aluminum slabs, cooling rate $V_k$ is within the range of $2\times10^{6\circ}$ C./s~$6\times10^{6\circ}$ C./s, and Δm is within the range of 0.176 mm~0.102 mm. When the thickness of aluminum slabs is less than 1.76 mm~1.02 mm, then Δm>E/10, which does not meet the requirement for one-dimensional stable-state heat conduction. For Crystallite A aluminum slab, Δm=0.249 mm. When the thickness of aluminum slabs is less than 2.5 mm, it does not meet the requirement for one-dimensional stable-state heat conduction. For Crystallite B aluminum slab, Δm=0.786 mm. When the thickness of aluminum slabs is less than 7.86 mm, it does not meet the requirement for one-dimensional stable-state heat conduction. For fine grain aluminum slab, because Δm=2.49 mm, the thickness of aluminum slabs must be larger than 25 mm to meet the requirement for one-dimensional stable-state heat conduction.

Table 9-table 14 also provide the relevant data of adjustment range for L, R, C method and its continuous casting ejection system at liquid nitrogen's ejection quantity V and ejection speed K.

In order to keep Cross Section b at the outlet of the hot casting mould shown in FIG. 2, when designing the guidance traction device (6) and liquid nitrogen ejector (5), one must consider to fine-tune the continuous casting speed u and the ejection quantity V of liquid nitrogen according to the actual position of Cross Section b to ensure that Cross Section b is at the right position of the hot casting mould's outlet. For Cross Section C where the liquid nitrogen's ejection comes into contact with the shaped metal (slab) (7), the structure of the nozzle shown in FIG. 2 should be amended to ensure that the liquid nitrogen's ejection comes into contact with the shaped metal (slab) on Crosse Section c.

The application of the L,R,C method and its continuous casting machine is diversified. They can continuously cast amorphous, ultracrystallite, crystallite and fine grain metallic slabs or other shaped metals in all kinds of models and specifications. These metals include ferrous and nonferrous metals, such as steel, aluminum, copper and titanium. To determine the working principles and production parameters, one can refer to the calculations for continuously casting amorphous, ultracrystallite, minicystal and fine grain metal slabs of 0.23C steel and aluminum.

Figure 4:
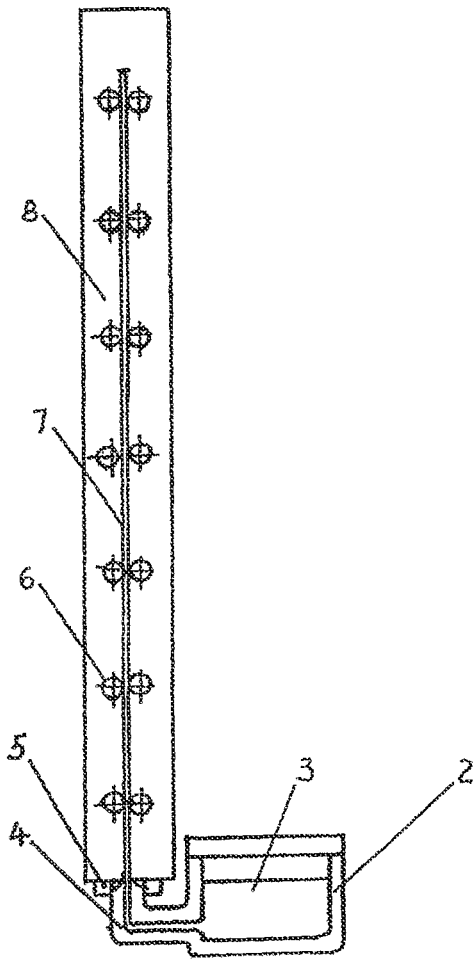
FIG. 4 is a drawing that illustrates the principle of casting amorphous, ultracrystallite, crystallite and fine grain metallic slabs or other shaped metals through a hot casting mould with an upward outlet, by using the L,R,C method and its continuous casting system.

FIG. 4 shows the principle of casting metal slabs or other shaped metals of amorphous, ultracrystallite, crystallite and fine grain structures by using hot casting mould with an upward outlet. This is an alternative scheme, and will not be described in detail herein.

Using L,R,C method and its continuous casting system to cast amorphous, ultracrystallite, crystallite and fine grain metallic slabs or other shaped metals has the following economic benefits.

So far there is no factory or business in the world which can produce ferrous and nonferrous slabs or other shaped metals of amorphous, ultracrystallite, crystallite and fine crystal structures. However, this invention can do so. Products produced by the L,R,C method and its continuous casting system will dominate the related markets in the world for their excellent features and reasonable price.

Figure 1:
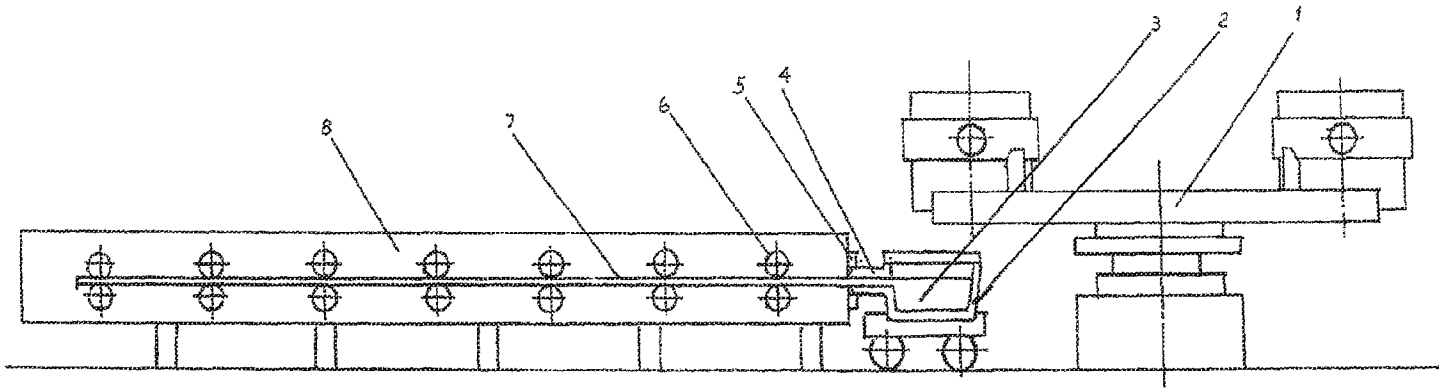
FIG. 1 is the schematic diagram of the L,R,C method and its continuous casting system used to cast metallic slabs or other shaped metals of amorphous, ultracrystallite, crystallite and fine grain.
Figure 3:
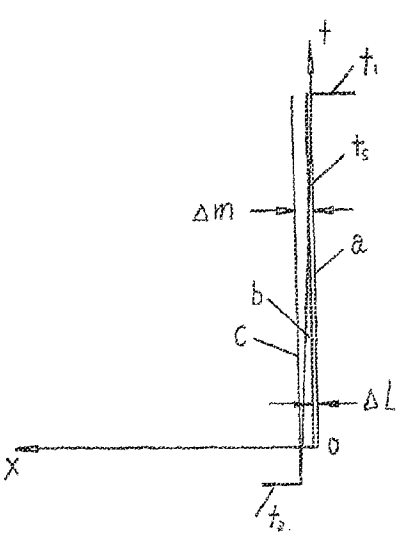
FIG. 3 is a drawing that illustrates the temperature distribution during rapid solidification and cooling of molten metal at the outlet of the hot casing mould.

The whole set of equipment of the L,R,C method and its continuous casting machine production line designed and manufactured according to the principle of L,R,C method and the relevant parameters shown in FIG. 1 and FIG. 2 will also dominate the international markets.

For large conglomerates which continuously cast amorphous, ultracrystallite, crystallite and fine grain metallic slabs or other shaped ferrous and nonferrous metals using the L,R,C method and its continuous casting machines, other than mines and smelteries, the basic compositions are smelting plants, air liquefaction and separation plants and L,R,C method continuous casting plants. There will be significant changes in old iron and steel conglomerates.

From the above, the economic benefits of the invention are beyond estimation,

APPENDIX I

Thermophysical Properties of Steel, Aluminum, Titanium and Copper at Different Temperatures

TABLE 15

Thermophysical properties of 0.23 C steel at different temperatures[7]

| Temperature | | Specific heat | | Enthalpy | | Thermal conductivity | | | |
|---|---|---|---|---|---|---|---|---|---|
| K | ° C. | J/Kg · K | kcal/Kg · K | KJ/Kg | kcal/Kg | W/m · K | kcal/m · h · K | cal/cm · s · K | |
| 273 | 0 | 469 | 0.112 | 0 | 0 | 51.8 | 44.6 | 0.124 | ρ = 7.86(15° C.) |
| 373 | 100 | 485 | 0.116 | 47.7 | 11.4 | 51.0 | 43.9 | 0.122 | BOH 930° C. |
| 473 | 200 | 519 | 0.124 | 98.7 | 23.6 | 48.6 | 41.8 | 0.116 | anneal |
| 573 | 300 | 552 | 0.132 | 153.1 | 36.6 | 44.4 | 38.2 | 0.106 | 0.23 C, 0.11Si |
| 673 | 400 | 594 | 0.142 | 211.7 | 50.6 | 42.6 | 36.7 | 0.102 | 0.63Mn, 0.034S |
| 773 | 500 | 661 | 0.158 | 276.1 | 66.0 | 39.3 | 33.8 | 0.094 | 0.034P, 0.07Ni |
| 873 | 600 | 745 | 0.178 | 348.5 | 83.3 | 35.6 | 30.6 | 0.085 | the specific |
| 973 | 700 | 845 | 0.202 | 430.1 | 102.8 | 31.8 | 27.4 | 0.076 | heat is the |
| 1023 | 750 | 1431 | 0.342 | 501.7 | 119.9 | 28.5 | 24.5 | 0.068 | mean value |
| 1073 | 800 | 954 | 0.228 | 549.4 | 131.3 | 25.9 | 22.3 | 0.062 | below 50° C. |
| 1173 | 900 | 644 | 0.154 | 618.4 | 147.8 | 26.4 | 22.7 | 0.063 | |
| 1273 | 1000 | 644 | 0.154 | 683.2 | 163.6 | 27.2 | 23.4 | 0.065 | |
| 1373 | 1100 | 644 | 0.154 | 748.1 | 178.8 | 28.5 | 24.5 | 0.068 | |
| 1473 | 1200 | 661 | 0.158 | 814.2 | 194.6 | 29.7 | 25.6 | 0.071 | |
| 1573 | 1300 | 686 | 0.164 | 882.4 | 210.9 | | | | |

TABLE 16

Thermophysical properties of common nonferrous metals at different temperatures [8] Aluminum Al

| temperature ° C. | density g/cm$^3$ | Specific heat at constant pressure $C_P$ KJ/Kg · ° C. | (kcal/· ° C.) | Thermal conductivity λ W/m · ° C. | (kcal/m · h · ° C.) |
|---|---|---|---|---|---|
| 20 | 2.696 | 0.896 | (0.214) | 206 | (177) |
| 100 | 2.690 | 0.942 | (0.225) | 205 | (176) |
| 300 | 2.65 | 1.038 | (0.248) | 230 | (198) |
| 400 | 2.62 | 1.059 | (0.253) | 249 | (214) |
| 500 | 2.58 | 1.101 | (0.263) | 268 | (230) |
| 600 | 2.55 | 1.143 | (0.273) | 280 | (241) |
| 800 | 2.35 | 1.076 | (0.257) | 63 | (54) |

Melting point=(660±1)° C.

Boiling point=(2320±50)° C.

Latent heat of melting $q_{melt}$=(94±1) kcal/Kg

The mean specific heat at constant pressure $C_p$=0.214+0.5×$10^{-4}$ t, kcal/Kg·° C.

(the above formula applies at 0~600° C.).

The mean specific heat at constant pressure $C_p$=−0.26 kcal/Kg·° C.

(applies at 658.6~1000° C.).

Determining the Mean Value of Thermophysical Properties of Metal

The data of thermophysical properties of ferrous and nonferrous metals varies with the temperature. When calculating production parameters, the mean value of thermophysical properties is adopted in the process. However, at present, in the data of a metal's thermophysical properties and temperature, the range of temperatures only contains normal temperatures. There is no data for thermophysical properties under 0° C. For convenience, the data of thermal properties at low temperature only adopts data of thermal properties at 0° C. However, the mean value of thermal properties obtained in this way tends to be higher than the actual value. Thus, production parameters obtained by using the mean value of thermophysical properties are also higher than actual values. Correct production parameters must be determined through production trials.

Determining the Mean Value of Thermophysical Properties of 0.23C Steel

Determining the Mean Specific Heat $C_{cp}$

The data of the relationship between temperature and specific heat of 0.23C steel obtained from table 15 is listed in table 17.

TABLE 17

The relationship between temperature and specific heat of 0.23 C steel

| | t ° C. | | | | | | | | | | | | | | |
|---|---|---|---|---|---|---|---|---|---|---|---|---|---|---|---|
| | 0 | 100 | 200 | 300 | 400 | 500 | 600 | 700 | 750 | 800 | 900 | 1000 | 1100 | 1200 | 1300 |
| C KJ/Kg · K | 0.469 | 0.485 | 0.519 | 0.552 | 0.594 | 0.661 | 0.745 | 0.854 | 1.431 | 0.954 | 0.644 | 0.644 | 0.644 | 0.661 | 0.686 |

From table 17, when temperature is below 750° C., specific heat falls with temperature. All data of specific heat below 0° C. is deemed as data of specific heat at 0° C., which is 0.469 KJ/Kg·K. The value is higher than it actually is.

In the process of rapid solidification and cooling, the transformation temperature $T_g$ and melting point temperature $T_{melt}$ of amorphous metal has a relationship of $T_g/T_m$>0.5[1].

The 0.23C molten steel rapidly dropping from 1550° C. to 750° C. is the temperature range in which amorphous transformation takes place. From the data of the relationship between t and C shown in FIG. 17, it can be seen that the mean value of specific heat, calculated at this temperature range is higher than actual. Taking this mean value of specific heat as the mean value of the specific heat in the whole process of temperature dropping from 1550° C. to −190° C. should be higher than actual and should be reliable.

The mean value of specific heat at a temperature range of 1330° C.-1550° C. Let the value $C_1$ of molten steel's specific heat be the mean value of the specific heat at this temperature range.

$$C_L=0.84\text{KJ/Kg}\cdot{}^\circ\text{ C.}^{[8]}$$

Calculate the mean value $C_{cp1}$ of specific heat at 1300° C.-750° C.

$$C_{CP1}=(0.686+0.661+0.644+0.644+0.644+0.954+1.431)\div 7=0.8031\text{ KJ/Kg}\cdot{}^\circ\text{ C.}$$

Calculate the mean value $C_{cp1}$ of specific heat at 1550° C.-750° C.

$$C_{CP2}=(C_L C_{CP1})\div 2=(0.84+0.8031+2=0.822\text{ KJ/Kg}\cdot{}^\circ\text{ C.}$$

Let the mean value of specific heat of 0.23C steel $C_{CP}$=0.822 KJ/Kg·° C.

Determining the Mean Thermal Conductivity $\lambda_{CP}$

TABLE 18

Relationship between temperature and the thermal conductivity of 0.23 C steel

| | t ° C. | | | | | | | | | | | | | |
|---|---|---|---|---|---|---|---|---|---|---|---|---|---|---|
| | 0 | 100 | 200 | 300 | 400 | 500 | 600 | 700 | 750 | 800 | 900 | 1000 | 1100 | 1200 |
| $\lambda_{W/m}\cdot{}^\circ$ C. | 51.8 | 51.0 | 48.6 | 44.4 | 42.6 | 39.3 | 35.6 | 31.8 | 28.5 | 25.9 | 26.4 | 27.2 | 28.5 | 29.7 |

Calculate the mean value of thermal conductivity at temperatures 0° C.-120° C. $\lambda_{CP}$ $$\lambda_{CP}=\left(\begin{matrix}51.8+51.0+48.6+44.4+42.6+39.3+35.6+\\31.8+28.5+25.9+26.4+27.2+28.5+29.7\end{matrix}\right)\Big/14$$
$$=36.5\text{ W/m. °C}$$

Let the mean value of thermal conductivity of 0.23 $\lambda_{CP}=36.5\times10^{-3}$ KJ/m·s.° C. From the value of λ at the temperature range 750° C.-1200° C., it can seen that $\lambda_{CP}$=36.5 KJ/m·s.° C. is higher than actual. Using it to calculate the quantity of heat transmission and the quantity of ejected liquid nitrogen is also higher than actual and is reliable.

Determining the Mean Value of the Thermophysical Properties of Aluminum

Determining the Mean Specific Heat $C_{cp}$

TABLE 19

Relationship between temperature and specific heat of aluminum

| | T ° C. | | | | | | |
|---|---|---|---|---|---|---|---|
| | 20 | 100 | 300 | 400 | 500 | 600 | 800 |
| $C_P$ KJ/Kg · K | 0.896 | 0.942 | 1.038 | 1.059 | 1.101 | 1.143 | 1.076 |

Calculate the mean value of specific heat of aluminum $C_{CP}$ $$C_{CP}=(1.038+1.059+1.101+1.143)/4=1.085\text{ KJ/Kg}\cdot{}^\circ\text{ C.}$$

Let the mean value of specific heat of aluminum $C_{CP}$=1.085 KJ/Kg·° C.

Determining the Mean Thermal Conductivity $\lambda_{CP}$

TABLE 20

Relationship between temperature and thermal conductivity of aluminum

| | T ° C. | | | | | | |
|---|---|---|---|---|---|---|---|
| | 20 | 100 | 300 | 400 | 500 | 600 | 800 |
| λ KJ/m · s · ° C. | 206 | 205 | 230 | 249 | 268 | 280 | 63 |

Calculate the mean value $\lambda_{CP}$ of thermal conductivity of aluminum at temperatures 300° C.-600° C.

$$\lambda_{CP}=(230+249+268+280)/4=256.8\times10^{-3}\text{ KJ/m·s.° C.}$$

Let the mean value of thermal conductivity of aluminum $\lambda_{CP}=256.8\times10^{-3}$ KJ/m·s.° C.

Determining the Mean Density $\rho_{CP}$

TABLE 21

Relationship between temperature and density of aluminum

| | T ° C. | | | | | | |
|---|---|---|---|---|---|---|---|
| | 20 | 100 | 300 | 400 | 500 | 600 | 800 |
| ρ g/cm³ | 2.696 | 2.690 | 2.65 | 2.62 | 2.58 | 2.55 | 2.35 |

Calculate the mean value $\rho_{CP}$ of density of aluminum at temperatures 300° C.-600° C.

$$\rho_{CP}=(2.65+2.62+2.58+2.55)/4=2.591\times10^3\text{ Kg/m}^3$$

Let the mean value of density of aluminum $\rho_{CP}=2.591\times10^3$ Kg/m³

The thermophysical properties of other nonferrous metals, such as aluminum alloy, copper alloy, titanium alloy, can be found in the relevant manual. So they will not be repeated herein.

Appendix 2 the thermophysical properties of the liquid nitrogen[10]

Chapter 5
NITROGEN AND AMMONIA
NITROGEN ($N_2$)
Molecular weight 28.016
$T_{boil}$ = 77.35k at 760 mmHg; $t_{melt}$ = 63.15k; $t_{cr}$ = 126.25k
$P_{cr}$ = 33.96 bar; $\rho_{cr}$ = 304 Kg/m$^3$
Thermodynamic properties of saturated nitrogen [141, 142]
V (dm$^3$/Kg), Cp (KJ/Kg · deg), i and r (KJ/Kg) and S (KJ/Kg · deg)

| T ° K | P bar | V' | V" | Cp' | I' | i" | r | S' | S" |
|---|---|---|---|---|---|---|---|---|---|
| 63.15 | 0.1253 | 1.155 | 1477.00 | 1.928 | −148.5 | 64.1 | 212.6 | 2.459 | 5.826 |
| 64.00 | 0.1462 | 1.159 | 1282.00 | 1.929 | −146.8 | 64.9 | 211.7 | 2.435 | 5.793 |
| 65.00 | 0.1743 | 1.165 | 1091.00 | 1.930 | −144.9 | 65.8 | 210.7 | 2.516 | 5.757 |
| 66.00 | 0.2065 | 1.170 | 933.10 | 1.931 | −142.9 | 66.8 | 209.7 | 2.545 | 5.722 |
| 67.00 | 0.2433 | 1.176 | 802.60 | 1.932 | −141.0 | 67.7 | 208.7 | 2.753 | 5.688 |
| 68.00 | 0.2852 | 1.181 | 693.80 | 1.933 | −139.1 | 68.7 | 207.8 | 2.600 | 5.656 |
| 69.00 | 0.3325 | 1.187 | 602.50 | 1.935 | −137.1 | 69.6 | 206.7 | 2.629 | 5.625 |
| 70.00 | 0.3859 | 1.193 | 525.60 | 1.935 | −135.2 | 70.5 | 205.7 | 2.657 | 5.595 |
| 71.00 | 0.4457 | 1.199 | 460.40 | 1.939 | −133.3 | 71.4 | 204.7 | 2.683 | 5.566 |
| 72.00 | 0.5126 | 1.205 | 405.00 | 1.941 | −131.4 | 72.3 | 203.7 | 2.709 | 5.538 |
| 73.00 | 0.5871 | 1.211 | 357.60 | 1.943 | −129.4 | 73.2 | 202.6 | 2.736 | 5.511 |
| 74.00 | 0.6696 | 1.217 | 316.90 | 1.945 | −127.4 | 74.1 | 201.4 | 2.763 | 5.485 |
| 75.00 | 0.7609 | 1.224 | 281.80 | 1.948 | −125.4 | 74.9 | 200.3 | 2.789 | 5.460 |
| 76.00 | 0.8614 | 1.230 | 251.40 | 1.951 | −123.4 | 75.7 | 199.1 | 2.816 | 5.436 |
| 77.00 | 0.9719 | 1.237 | 224.90 | 1.954 | −121.4 | 76.5 | 197.9 | 2.842 | 5.412 |
| 78.00 | 1.0930 | 1.244 | 201.90 | 1.957 | −119.5 | 77.3 | 196.8 | 2.866 | 5.389 |
| 79.00 | 1.2250 | 1.251 | 181.70 | 1.960 | −117.6 | 78.1 | 195.7 | 2.890 | 5.367 |
| 80.00 | 1.3690 | 1.258 | 164.00 | 1.964 | −115.6 | 78.9 | 194.5 | 2.913 | 5.345 |
| 81.00 | 1.5250 | 1.265 | 148.30 | 1.968 | −113.6 | 79.6 | 193.2 | 2.938 | 5.324 |
| 82.00 | 1.6940 | 1.273 | 134.50 | 1.973 | −111.6 | 80.3 | 191.9 | 2.963 | 5.303 |
| 83.00 | 1.8770 | 1.281 | 122.30 | 1.978 | −109.7 | 81.0 | 190.7 | 2.986 | 5.283 |
| 84.00 | 2.0740 | 1.289 | 111.40 | 1.983 | −107.7 | 81.7 | 189.3 | 3.009 | 5.263 |
| 85.00 | 2.2870 | 1.297 | 101.70 | 1.989 | −105.7 | 82.3 | 188.0 | 3.032 | 5.244 |
| 86.00 | 2.5150 | 1.305 | 93.02 | 1.996 | −103.7 | 82.9 | 186.6 | 3.055 | 5.225 |
| 87.00 | 2.7600 | 1.314 | 85.24 | 2.003 | −101.7 | 83.5 | 185.1 | 3.078 | 5.206 |
| 88.00 | 3.0220 | 1.322 | 78.25 | 2.011 | −99.7 | 84.0 | 183.7 | 3.100 | 5.118 |
| 89.00 | 3.3020 | 1.331 | 71.96 | 2.019 | −97.7 | 84.5 | 182.2 | 3.123 | 5.170 |
| 90.00 | 3.6000 | 1.340 | 66.28 | 2.028 | −95.6 | 85.0 | 180.5 | 3.147 | 5.152 |
| 91.00 | 3.9180 | 1.349 | 61.14 | 2.037 | −93.5 | 85.4 | 178.9 | 3.169 | 5.134 |
| 92.00 | 4.2560 | 1.359 | 56.48 | 2.048 | −91.5 | 85.8 | 177.3 | 3.190 | 5.117 |
| 93.00 | 4.6150 | 1.369 | 52.25 | 2.060 | −89.4 | 86.2 | 175.6 | 3.212 | 5.100 |
| 94.00 | 4.9950 | 1.379 | 48.39 | 2.073 | −87.3 | 86.5 | 173.8 | 3.235 | 5.084 |
| 95.00 | 5.3980 | 1.390 | 44.87 | 2.086 | −85.2 | 86.8 | 172.0 | 3.256 | 5.067 |
| 96.00 | 5.8240 | 1.400 | 41.66 | 2.101 | −83.1 | 87.1 | 170.2 | 3.277 | 5.050 |
| 97.00 | 6.274 | 1.411 | 38.720 | 2.117 | −81.0 | 87.3 | 168.3 | 3.299 | 5.034 |
| 98.00 | 6.748 | 1.423 | 36.020 | 2.135 | −78.8 | 87.5 | 166.3 | 3.320 | 5.017 |
| 99.00 | 7.248 | 1.435 | 33.540 | 2.155 | −76.6 | 87.6 | 164.2 | 3.342 | 5.001 |
| 100.00 | 7.775 | 1.447 | 31.260 | 2.176 | −74.5 | 87.7 | 162.2 | 3.363 | 4.985 |
| 101.00 | 8.328 | 1.459 | 29.160 | 2.199 | −72.3 | 87.7 | 160.0 | 3.385 | 4.969 |
| 102.00 | 8.910 | 1.472 | 27.220 | 2.225 | −70.1 | 87.7 | 157.8 | 3.406 | 4.953 |
| 103.00 | 9.520 | 1.485 | 25.430 | 2.254 | −67.8 | 87.7 | 155.5 | 3.426 | 4.936 |
| 104.00 | 10.160 | 1.499 | 23.770 | 2.285 | −65.6 | 87.6 | 153.2 | 3.447 | 4.920 |
| 105.00 | 10.830 | 1.514 | 22.230 | 2.319 | −63.8 | 87.4 | 150.7 | 3.469 | 4.904 |
| 106.00 | 11.530 | 1.529 | 20.790 | 2.356 | −61.0 | 87.2 | 148.2 | 3.489 | 4.887 |
| 107.00 | 12.270 | 1.544 | 19.460 | 2.398 | −58.6 | 86.5 | 142.8 | 3.532 | 4.854 |
| 108.00 | 13.030 | 1.560 | 18.220 | 2.445 | −56.2 | 86.5 | 142.8 | 3.532 | 4.854 |
| 109.00 | 13.830 | 1.578 | 17.060 | 2.500 | −53.8 | 86.1 | 139.9 | 3.554 | 4.837 |
| 110.00 | 14.670 | 1.597 | 15.980 | 2.566 | −51.4 | 85.6 | 137.0 | 3.575 | 4.820 |
| 111.00.. | 15.540 | 1.617 | 14.960 | 2.645 | −48.9 | 85.1 | 134.0 | 3.596 | 4.803 |
| 112.00 | 16.450 | 1.639 | 14.000 | 2.736 | −46.3 | 84.4 | 130.7 | 3.618 | 4.785 |
| 113.00 | 17.390 | 1.662 | 13.100 | 2.836 | −43.7 | 83.6 | 127.3 | 3.640 | 4.767 |
| 114.00 | 18.360 | 1.687 | 12.260 | 2.945 | −41.0 | 82.8 | 123.8 | 3.662 | 4.748 |
| 115.00 | 19.400 | 1.714 | 11.470 | 3.063 | −38.1 | 81.8 | 119.9 | 3.687 | 4.729 |
| 116.00 | 20.470 | 1.744 | 10.710 | | −35.1 | 80.7 | 115.8 | 3.711 | 4.709 |
| 117.00 | 21.580 | 1.776 | 9.996 | | −31.9 | 79.4 | 111.3 | 3.737 | 4.688 |
| 118.00 | 22.720 | 1.811 | 9.314 | | −28.6 | 77.9 | 106.5 | 3.764 | 4.666 |
| 119.00 | 23.920 | 1.849 | 8.660 | | −25.1 | 76.2 | 101.3 | 3.792 | 4.643 |
| 120.00 | 25.150 | 1.892 | 8.031 | | −21.4 | 74.3 | 95.7 | 3.821 | 4.619 |
| 121.00 | 26.440 | 1.942 | 7.421 | | −17.3 | 72.1 | 89.4 | 3.853 | 4.592 |
| 122.00 | 27.770 | 2.000 | 6.821 | | −12.9 | 69.4 | 82.3 | 3.887 | 4.562 |
| 123.00 | 29.140 | 2.077 | 6.225 | | −8.0 | 66.4 | 74.4 | 3.924 | 4.529 |
| 124.00 | 30.570 | 2.177 | 5.636 | | −2.3 | 62.6 | 64.9 | 3.968 | 4.491 |
| 125.00 | 32.050 | 2.324 | 5.016 | | 5.1 | 57.9 | 52.8 | 4.024 | 4.444 |
| 126.00 | 33.570 | 2.637 | 4.203 | | 17.4 | 49.5 | 32.1 | 4.118 | 4.365 |
| 126.25 | 33.960 | 3.289 | 3.289 | | 34.8 | 34.8 | 0.0 | 4.252 | 4.252 |

REFERENCES

[1] Li Yue Zhu. The technology and material of rapid solidification. Beijing: National Defence Industry Press, 1993. 11:3-8, 22.

[2] Zhou Yao He, Hu Zhuang Qi, Jie Man Qi. The solidification technology. Bejing: Machinery Industry Press, 1998.10:227-224

[3] Cui Zhong Qi. Metallography and heat treatment. Beijing: Machinery Industry Press: 54-55.

[4] Li Wen Bin. Applied engineering of low temperature. Beijing: Weaponry Industry Press, 1992.6.

[5]W. R. Gambill et al.; CEP Symp. Ser., 57 (32); 127-137 (1961); R. Viskanta, Nuclear Eng. Sci., 10; 202 (1961).

[6] Wang Bu Xuan. The engineering of heat transfer and mass transfer (last of two volumes). Beijing: Science press. 1998.9:173.

[7] Turkdcgan, E. T. Iron making and steel—making, 1985, 5:79-86.

[8] Cai Kai Ke, Pan Yu Chun, Zhao Jia Gui. The 500 questions of continuous steel casting. Beijing: Metallurgical Industry Press, 1997. 10:208.

[9] ガ〉., 日本金 会, 44 (1980)94.

[10] N. B. Vargaftik: Tale on the Thermophysical properties of Liquids and Gases, and. E d., John willey & son, Inc., 1975. Chapter 5.

What is claimed is:

1. A method for casting a metal article, the method comprising providing an enclosed area comprising a traction bar configured to move at a continuous casting speed, wherein the enclosed area is kept at a substantially constant ambient temperature of −190° C. and a pressure of 1 Bar;

ejecting liquid nitrogen to cool a portion of the traction bar located at the outlet of an hot casting mould; wherein the liquid nitrogen is ejected at a rate sufficient to maintain a predetermined cooling rate over a selected time interval when molten metal is extruded from the hot casting mould onto the traction bar;

extruding molten metal from the outlet of the hot casting mould onto the traction bar to form a solidified metal portion, wherein the traction bar is moved as the molten metal is extruded to maintain a continuous casting speed within the selected time interval;

cutting the solidified metal portion to form the metal article.

2. The method of claim 1, wherein the metal article comprises amorphous metal.

3. The method of claim 1, wherein the metal article comprises ultracrystalline metal.

4. The method of claim 1, wherein the metal article comprises fine grain metal.

5. The method according to claim 1, wherein the metal article comprises a ferrous metal.

6. The method according to claim 1, wherein the metal article comprises a nonferrous metal.

* * * * *